US007973761B2

(12) United States Patent
Yokoo et al.

(10) Patent No.: US 7,973,761 B2
(45) Date of Patent: Jul. 5, 2011

(54) METHOD OF DRIVING INFORMATION DISPLAY PANEL

(75) Inventors: Akihiko Yokoo, Kodaira (JP); Norio Nihei, Higashiyamato (JP)

(73) Assignee: Bridgestone Corporation, Tokyo (JP)

( * ) Notice: Subject to any disclaimer, the term of this patent is extended or adjusted under 35 U.S.C. 154(b) by 1014 days.

(21) Appl. No.: 11/600,073

(22) Filed: Nov. 16, 2006

(65) Prior Publication Data

US 2007/0120816 A1 May 31, 2007

(30) Foreign Application Priority Data

Nov. 16, 2005 (JP) ..... 2005-331925
Nov. 16, 2005 (JP) ..... 2005-331939
Nov. 13, 2006 (JP) ..... 2006-307037

(51) Int. Cl.
*G09G 3/34* (2006.01)

(52) U.S. Cl. ..... 345/107; 359/296

(58) Field of Classification Search ..... 345/107; 359/296

See application file for complete search history.

(56) References Cited

U.S. PATENT DOCUMENTS 4,904,064 A 2/1990 Lagerwall et al.
5,451,978 A * 9/1995 Harju ..... 345/78
5,598,178 A 1/1997 Kawamori
2002/0021483 A1* 2/2002 Katase ..... 359/267
2005/0104845 A1 5/2005 Moon

FOREIGN PATENT DOCUMENTS

WO 2005/054932 A2 6/2005

OTHER PUBLICATIONS

European Search Report dated Nov. 26, 2008 (6 pages).

* cited by examiner

*Primary Examiner* — Sumati Lefkowitz
*Assistant Examiner* — Robert E Carter, III
(74) *Attorney, Agent, or Firm* — Sughrue Mion, PLLC

(57) ABSTRACT

In a method of driving an information display panel of a passive matrix driving type, in which display media are sealed in a space between two substrates, at least one substrate being transparent, and, in which an electrostatic field, which is generated from an electrode at scan side and an electrode at data side arranged respectively to the opposed substrates in an intersected manner, is applied to the display media so as to display information such as an image, at least two or more voltage values or an open state (including a connection state under a high-impedance state) are applied to at least one electrode. According to the invention, it is possible to obtain a method of driving an information display panel, which can reduce a cross-talk occurring voltage generated between the electrode at scan side and the electrode at data side and thus improve a display quality.

7 Claims, 23 Drawing Sheets

| | select | non-select |
|---|---|---|
| electrode at scan side | 80V | open |
| electrode at data side | 0V | 40V |

| | select | non-select |
|---|---|---|
| electrode at scan side | 60V | open |
| electrode at data side | -20V | 20V |

| | select | non-select |
|---|---|---|
| electrode at scan side | -80V | open |
| electrode at data side | 0V | -40V |

| | select | non-select |
|---|---|---|
| electrode at scan side | 80V | open |
| electrode at data side | 0V | 40V |
| dummy electrode at data side | — | 0V |

| | select | non-select |
|---|---|---|
| electrode at scan side | 60V | open |
| electrode at data side | -20V | 20V |
| dummy electrode at data side | — | -20V |

| | select | non-select |
|---|---|---|
| electrode at scan side | -80V | open |
| electrode at data side | 0V | -40V |
| dummy electrode at data side | — | 0V |

| | select | non-select |
|---|---|---|
| electrode at scan side | 80V | 0V |
| electrode at data side | 0V | 40V |

METHOD OF DRIVING INFORMATION DISPLAY PANEL

BACKGROUND OF THE INVENTION

1. Field of the Invention

The present invention relates to a method of driving an information display panel of a passive matrix driving type, in which display media are sealed in a space between two substrates, at least one substrate being transparent, and, in which an electrostatic field, which is generated from an electrode at scan side and an electrode at data side arranged respectively to the opposed substrates in an intersected manner, is applied to the display media so as to display information such as an image.

2. Description of Related Art

As an information display device substitutable for liquid crystal display (LCD), information display devices with the use of technology such as an electrophoresis method, an electro-chromic method, a thermal method, dichroic-particles-rotary method are proposed.

As for these information display devices, it is conceivable as inexpensive visual display device of the next generation from a merit having wide field of vision close to normal printed matter, having smaller consumption with LCD, or having a memory function, and spreading out to a display for portable device and an electronic paper is expected. Recently, electrophoresis method is proposed that microencapsulate dispersion liquid made up with dispersion particles and coloration solution and dispose the liquid between faced substrates, and also it is expected.

However, in the electrophoresis method, there is a problem that a response rate is slow by the reason of viscosity resistance because the particles migrate among the electrophoresis solution. Further, there is a problem of lacking imaging repetition stability, because particles with high specific gravity of titanium oxide is scattered within solution of low specific gravity, it is easy to subside, difficult to maintain a stability of dispersion state. Even in the case of microencapsulating, cell size is diminished to a microcapsule level in order to make it hard to appear, however, an essential problem was not overcome at all.

Besides the electrophoresis method using behavior in the solution, recently, a method wherein electro-conductive particles and a charge transport layer are installed in a part of the substrate without using solution is proposed. [The Imaging Society of Japan "Japan Hardcopy '99" (Jul. 21-23, 1999) Transaction Pages 249-252] However, the structure becomes complicated because the charge transport layer and further a charge generation layer are to be arranged. In addition, it is difficult to constantly dissipate charges from the electro-conductive particles, and thus there is a drawback on the lack of stability.

As one method for overcoming the various problems mentioned above, an information display panel is known, in which at least one or more groups of display media having optical reflectance and charge characteristic, which are constituted by at least one of more groups of particles, are sealed between opposed two substrates, at least one substrate being transparent, and, in which the display media, to which an electrostatic field is applied, are made to move so as to display information such as an image.

In the known information display panel mentioned above, as one example of a method of driving for displaying information such as an image, in order to make a display information stable, there is known a method for applying an intermediate voltage V0 between a voltage VH and a voltage VL used for driving (for example, referred to Japanese Patent Laid-Open Publication No. 2003-248299).

FIG. 27 is a schematic view explaining one embodiment of a known method of driving an information display panel mentioned above. In the embodiment shown in FIG. 27, numerals 51-1 to 51-7 are electrodes at scan side and numerals 52-1 to 52-7 are electrodes at data side arranged in an intersected direction with respect to the electrodes 51-1 to 51-7 at scan side, in which, when information is displayed by scanning the electrodes 51-1 to 51-7 at scan side respectively in this order, a predetermined voltage is applied respectively to the electrodes 51-1 to 51-7 at scan side and the electrodes 52-1 to 52-7 at data side, which construct a matrix electrode, so as to display information such as an image. In this case, in the embodiment shown in FIG. 27, the number of the electrodes at scan side and the number of the electrodes at data side are respectively seven for a convenience of explanation, but actually necessary numbers of the electrodes at scan side and the electrodes at data side may be arranged.

In the embodiment shown in FIG. 27, when information is displayed by performing a scanning operation in an aligning direction of the electrodes 51-1 to 51-7 at scan side, at first, an overall black color display is performed by for example applying a voltage of 0V to the electrodes 51-1 to 51-7 at scan side and a voltage of 80V to the electrode 52-1 to 52-7 at data side. Then, as one example, a voltage of 80V is applied to the selected electrode 51-4 at scan side during writing, and a voltage of 0V is applied to the other non-selected electrodes 51-1 to 51-3 and 51-5 to 51-7 at scan side. In addition, a voltage of 0V is applied to the selected electrode 52-4 at data side during writing, and a voltage of 40V is applied to the other non-selected electrodes 52-1 to 52-3 and 52-5 to 52-7. In this manner, information is displayed.

In the known method of driving an information display panel mentioned above, even in the case such that a white color display or a black color display is maintained in a non-selected region, since a voltage difference of 40V (cross-talk voltage) is generated between the electrode at scan side and the electrode at data side, there is a drawback such that a cross-talk, in which a display becomes a gray color, occurs. Therefore, a display quality of the information display panel becomes sometimes deteriorated.

Here, a cross-talk means generally a phenomenon such that a signal on another line is mixed in a telephonic conversation. However, in this case, a cross-talk means a phenomenon such that an image that differs from actual one is displayed due to an influence of a voltage at data side generated in a non-selected pixel of the electrode at scan side by applying selected or non-selected voltage to lines of the electrodes at data side. Especially, in the display performing a passive matrix driving with respect to the information display panel using the display media mentioned above, a shading of the display is generated due to an influence of cross-talk on the non-selected electrode line at scan side in response to an applied voltage of the electrode at data side, and thus becomes an uneven display.

SUMMARY OF THE INVENTION

An object of the invention is to eliminate the drawbacks mentioned above and to provide a method of driving an information display panel, which can reduce a cross-talk occurring voltage generated between the electrode at scan side and the electrode at data side and thus improve a display quality.

According to the invention, a method of driving an information display panel of a passive matrix driving type, in which display media are sealed in a space between two substrates, at least one substrate being transparent, and, in which an electrostatic field, which is generated from an electrode at scan side and an electrode at data side arranged respectively to the opposed substrates in an intersected manner, is applied to the display media so as to display information such as an image, comprises a construction such that at least two or more voltage values or an open state (including a connection state under a high-impedance state) are applied to at least one electrode.

As a preferred embodiment of the information display panel according to the invention, there is a case: such that an applying voltage of the selected electrode at scan side is VS1, at least one electrode among the non-selected electrodes at scan side is open (including a connection state under a high-impedance state), and an applying voltage of the selected electrode at data side is VD1; such that whether a voltage applied to the non-selected electrode at data side is VD1 or an open state (including a connection state under a high-impedance state) is decided according to the number of the selected electrodes at data side, to which a voltage VD1 is applied; such that an open state (including a connection state under a high-impedance state) is realized by a connection of transistors; such that a dummy electrode is formed at a portion other than an information rewriting portion; such that a capacitance of a sum of cells formed by the dummy electrodes arranged other than the information rewriting portion is one third or more of a capacitance of a sum of cells formed by the electrodes arranged to the information rewriting portion; such that, in the case such that: an applying voltage of the selected electrode at scan side is VS1; at least one electrode among the non-selected electrodes at scan side is open (including a connection state under a high-impedance state); an applying voltage of the selected electrode at data side is VD1; at least one electrode among the non-selected electrode at data side is open (including a connection state under a high-impedance state); and an applying voltage of the other non-selected electrode at data side is VD2; when the dummy electrode is formed with respect to the electrode at data side, a voltage is applied to the dummy electrode according to the number of the electrodes to which VD1 is applied, the number of the electrodes to which VD2 is applied, and the number of the electrodes which are an open state; such that at least one group of the display media having optical reflectance and charge characteristics, formed by at least one group of particles, are sealed in the space between two substrates, at least one substrate being transparent; and such that the display media are particles or liquid powders, which are formed by at least one group of particles.

According to the invention, since at least two or more voltage values or an open state (including a connection state under a high-impedance state) are applied to at least one electrode, it is possible to obtain a method of driving an information display panel, which can reduce a cross-talk occurring voltage generated between the electrode at scan side and the electrode at data side and thus improve a display quality.

DESCRIPTION OF THE PREFERRED EMBODIMENT

Figure 1:
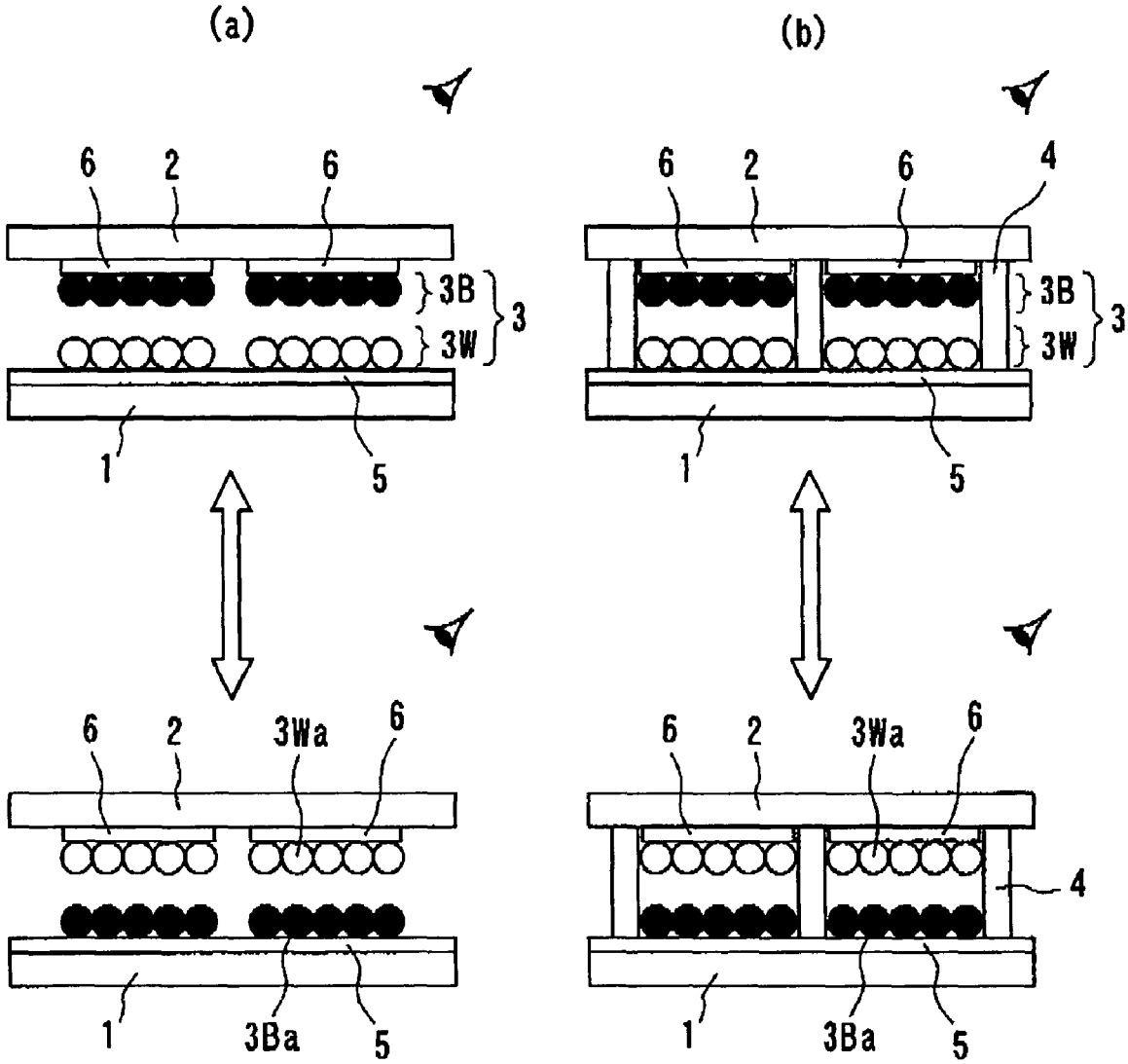
FIGS. 1*a* and 1*b* are schematic views respectively showing one embodiment of the information display panel, which is a driving object of the invention.
Figure 2:
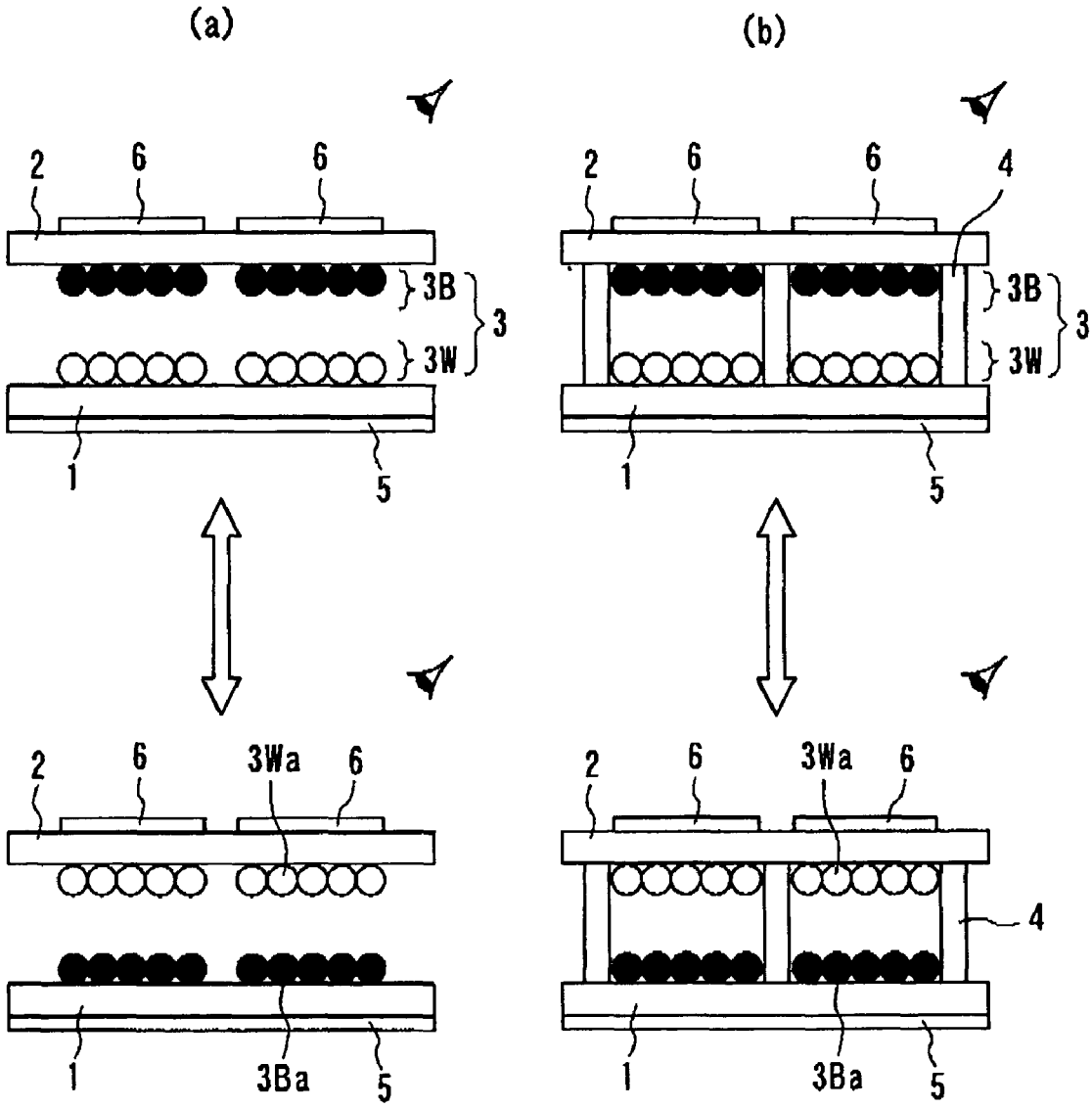
FIGS. 2*a* and 2*b* are schematic views respectively illustrating another embodiment of the information display panel, which is a driving object of the invention.
Figure 3:
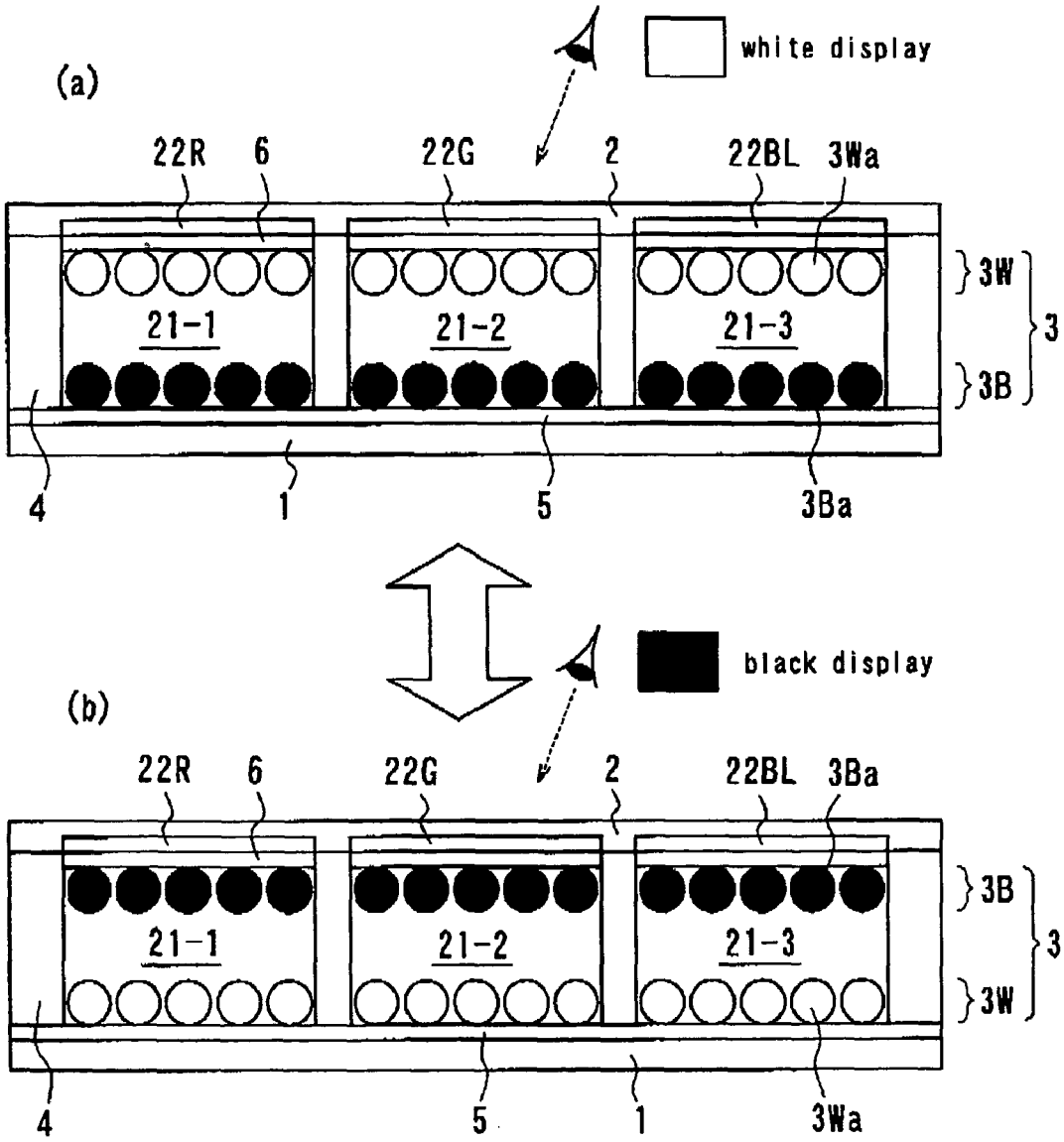
FIGS. 3*a* and 3*b* are schematic views respectively depicting still another embodiment of the information display panel, which is a driving object of the invention.

At first, a basic construction of an information display panel, which is an object of the driving method according to the present invention, will be explained. In the information display panel used in the present invention, an electrostatic field is applied to display media sealed in the space between two opposed substrates. Along a direction of the applied electrostatic field by means of the force of the electrostatic field, Coulomb's force or the like, the charged display media are attracted and moved by varying a direction of electrostatic field. Accordingly, information such as an image or the like can be displayed. Therefore, it is necessary to design the information display panel in such a manner that the display media can move evenly and maintain stability during a reciprocal operation or during a reserving state. Here, as to forces applied to the particles constituting display media, there are an attraction force between the particles due to Coulomb' force, an imaging force with respect to the electrodes or substrates, an intermolecular force, a liquid bonding force, a gravity and the like.

A basic constitution of the information display panel, which is an object of the driving method according to the invention, will be explained with reference to FIGS. 1*a* and 1*b*-FIG. 5.

In the examples shown in FIGS. 1*a* and 1*b*, at least two or more groups of display media 3 having different optical reflectance and charging characteristics and consisting of at least one or more groups of particles (here, a white particle 3W consisting of particles for white display media 3Wa and a black particle 3B consisting of particles for black display media 3Ba are shown) are moved perpendicularly with respect to substrates 1 and 2, in accordance with an electric field applied between an electrode 5 arranged inside of the substrate 1 and an electrode 6 arranged inside of the substrate 2. A white color is displayed by viewing the white particle 3W to an observer or a black color is displayed by viewing the black particle 3B to the observer. In the example shown in FIG. 1*b*, a cell is formed by arranging for example grid-like partition walls 4 between the substrates 1 and 2, in addition to the example shown in FIG. 1*a*. Moreover, in FIG. 1*b*, the partition walls arranged at the near side are omitted.

In the examples shown in FIGS. 2*a* and 2*b*, at least two or more groups of display media 3 having different optical reflectance and charging characteristics and consisting of at least one or more groups of particles (here, a white particle 3W consisting of particles for white display media 3Wa and a black particle 3B consisting of particles for black display media 3Ba are shown) are moved perpendicularly with respect to substrates 1 and 2, in accordance with an electric field applied between an electrode 5 arranged outside of the substrate 1 and an electrode 6 arranged outside of the substrate 2. A white color is displayed by viewing the white particle 3W to an observer or a black color is displayed by viewing the black particle 3B to the observer. In the example shown in FIG. 2*b*, a cell is formed by arranging for example grid-like partition walls 4 between the substrates 1 and 2, in addition to the example shown in FIG. 2*a*. Moreover, in FIG. 2*b*, the partition walls arranged at the near side are omitted.

In the examples shown in FIGS. 3*a* and 3*b*, a color display utilizing a display unit constituted by three cells is explained. In the examples shown in FIGS. 3*a* and 3*b*: the white color display media 3W and the black color display media 3B are filled in all cells 21-1 to 21-3 as the display media; a red color filter 22R is arranged to the first cell 21-1 at the observer's side; a green filter 22G is arranged to the second cell 21-2 at the observer's side; and a blue color filter 22BL is arranged to the third cell 21-3 at the observer's side, so that the display unit is constructed by the first cell 21-1, the second cell 21-2 and the third cell 21-3. In this embodiment, as shown in FIG. 3*a*, a white color display is performed for the observer by arranging the white color display media 3W to all the first cell 21-1 to the third cell 21-3 at the observer's side, or, as shown in FIG. 3*b*, a black color display is performed for the observer by arranging the black color display media 3B to all the first cell 21-1 to the third cell 21-3 at the observer's side. Moreover, in FIGS. 3*a* and 3*b*, the partition walls arranged at the near side are omitted.

The above explanations can be applied to a case such that the white color display media 3W made of the particles are substituted by white color display media made of the liquid powders or a case such that the black color display media 3B made of the particles are substituted by black color display media made of the liquid powders. The electrode may be arranged outside of the substrate as shown in the above or may be embedded in the substrate.

Figure 4:
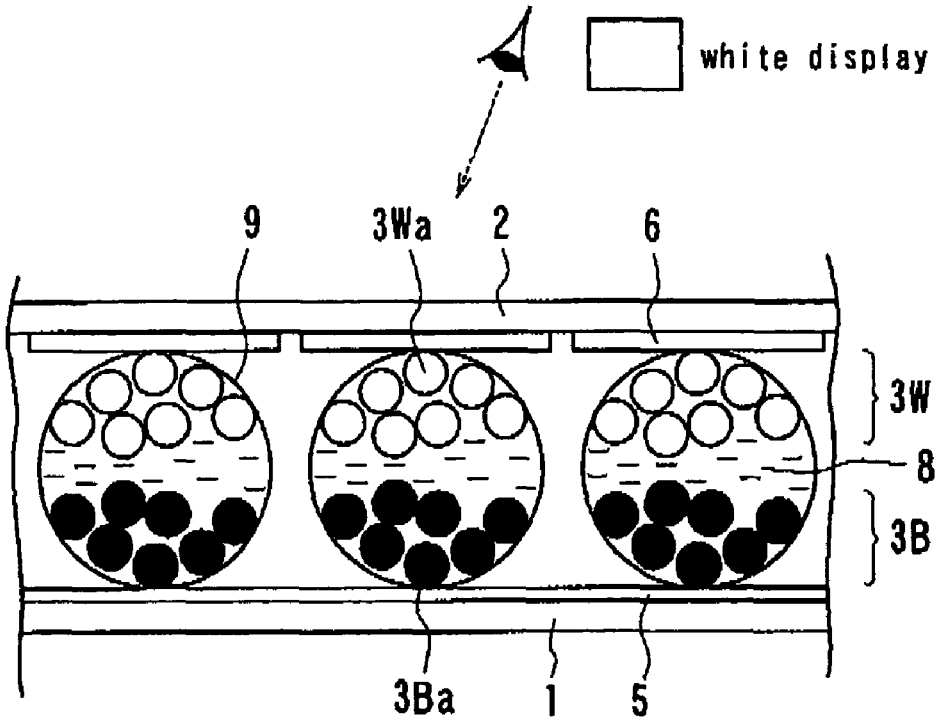
FIG. 4 is a schematic view showing still another embodiment of the information display panel, which is a driving object of the invention.
Figure 5:
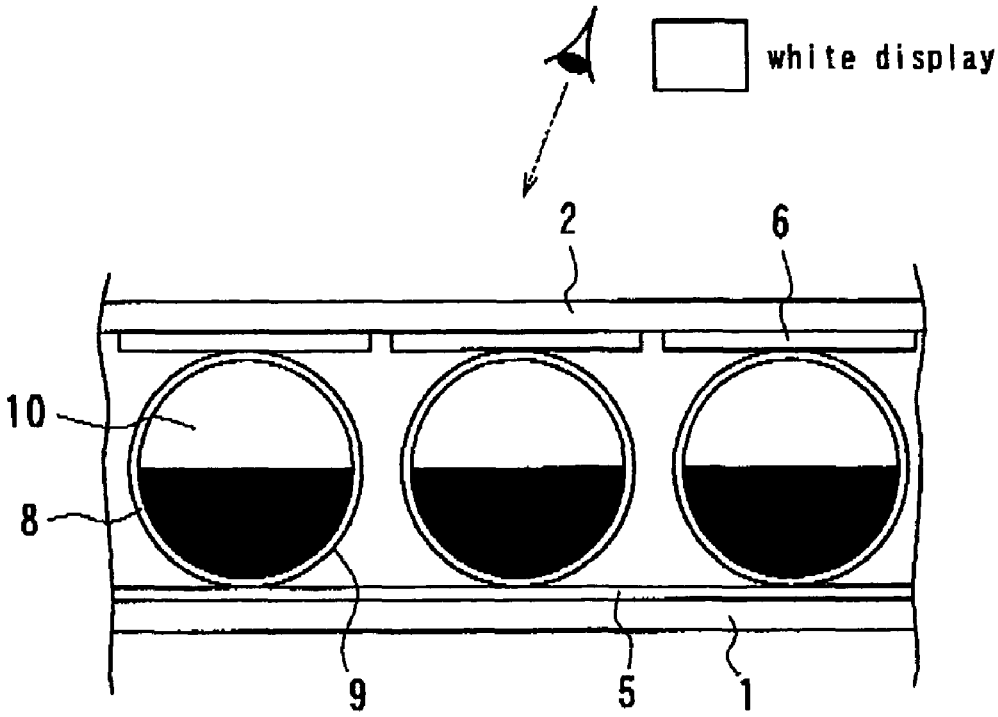
FIG. 5 is a schematic view illustrating still another embodiment of the information display panel, which is a driving object of the invention.

In the examples shown in FIG. 4 and FIG. 5, another embodiment, wherein the white/black color display is performed by utilizing the line electrodes 5 and 6 as is the same as the embodiment shown in FIG. 1*b*, is explained. In the example shown in FIG. 4, use is made of a micro capsule 9, in which the white color display media 3W and the black color display media 3B are filled together with an insulation liquid 8, in stead of the cell formed by the partition walls 4, in which the white color display media 3W and the black color display media 3B are filled as shown in FIG. 1*b*. Moreover, in the example shown in FIG. 5, use is made of a micro capsule 9, in which a rotating ball 10 whose surface is divided into halves, one half being a white color and the other half being a black color, is filled together with an insulation liquid 8, in stead of the cell formed by the partition walls 4, in which the white color display media 3W and the black color display media 3B are filled as shown in FIG. 1*b*. In both examples shown in FIG. 4 and FIG. 5, the white/black color display can be performed, as is the same as the embodiment shown in FIG. 1*b*.

Features of the first aspect of the invention lie on a method of driving the information display panel, in which display media are sealed in a space between two substrates, at least one substrate being transparent, and, in which an electrostatic field, which is generated from an electrode at scan side and an electrode at data side arranged respectively to the opposed substrates in an intersected manner, is applied to the display media so as to display information such as an image, having a construction such that at least two or more voltage values or an open state (including a connection state under a high-impedance state) are applied to at least one electrode.

Specifically, an applying voltage of the selected electrode at scan side is VS1, and at least one electrode among the non-selected electrodes at scan side is open (including a connection state under a high-impedance state). In addition, an applying voltage of the selected electrode at data side is VD1, and at least one electrode among the non-selected electrodes at data side is open (including a connection state under a high-impedance state). Here, the non-selected electrodes at scan side, which are not in an open state (including a connection state under a high-impedance state), are made to an arbitral applying voltage VS2, and the non-selected electrodes at data side, which are not in the open state (including a connection state under a high-impedance state), are made to an arbitral applying voltage VD2. This embodiment includes a case such that all the non-selected electrodes at scan side are open (including a connection state under a high-impedance state), and also includes a case such that all the non-selected electrodes at data side are the applying voltage VD2. Moreover, in this embodiment, the non-selected electrodes may be open (including a connection state under a high-impedance state) according to the number of the selected electrodes at data side, to which a voltage VD1 is applied. In this case, it is expected to obtain an effect for reducing power consumption.

Moreover, whether a voltage applied to the non-selected electrode at data side is VD2 or an open state (including a connection state under a high-impedance state) may be decided according to the number of the selected electrodes at data side, to which a voltage VD1 is applied. In this case, if the non-selected electrodes at data side are made to be open (including a connection state under a high-impedance state), it is possible to obtain an actual value.

Further, the open state may realize a connection state under a high-impedance state. As a method of obtaining a connection state under high-impedance, there is for example a method utilizing a power supply changing apparatus, a voltage changing-over switch, an output stage changing by means of driver IC and so on, and among them a connection utilizing transistors is preferably used.

Furthermore, it is preferred that use is made of the information display panel, in which at least one group of the display media having optical reflectance and charge characteristics, formed by at least one group of particles, are sealed in the space between two substrates, at least one substrate being transparent. In addition, it is preferred that the display media are particles or liquid powders, which are formed by at least one group of particles, and the display media, to which an electric field is applied, are made to move in an gaseous space so as to display information such as an image. However, the present invention may be effective for a display panel of a voltage driving type such as a liquid crystal that are not particles, two-colored rotation ball and so on, or may be effective for a display panel of electrophoresis type in which the display media are moved in a liquid space.

Hereinafter, the open state (including a connection state under a high-impedance state) will be explained at first, and then specific driving methods will be explained.

<As to the Open State (Including a Connection State Under a High-Impedance State)>

Figure 6:
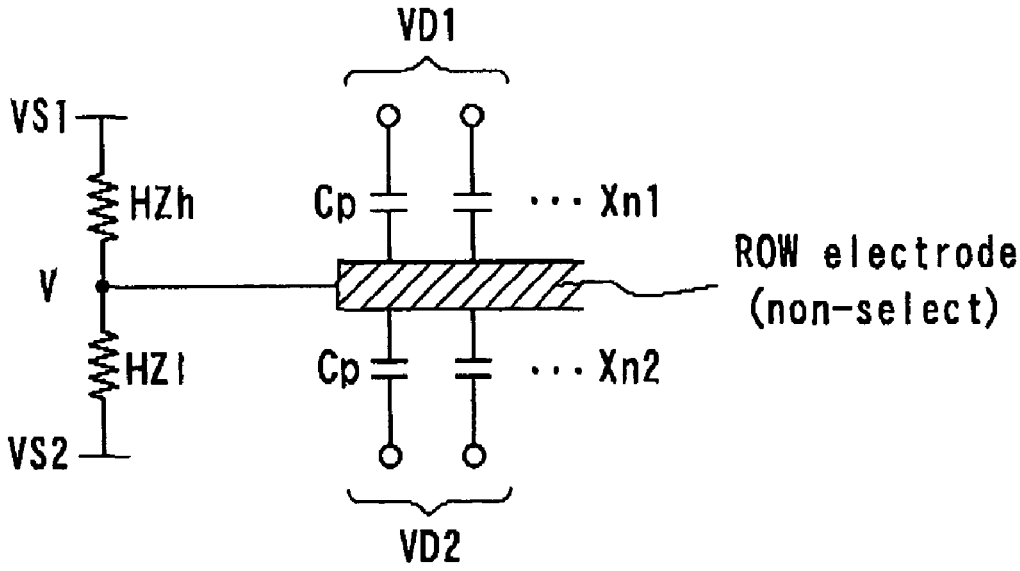
FIG. 6 is a schematic view explaining a high-impedance (HZ) state in a method of driving according to the invention.

With reference to FIGS. 6 to 10, the open state (including a connection state under a high-impedance state) will be explained. At first, the electrode (non-selected) at scan side shown in FIG. 6 is discussed. In the embodiment shown in FIG. 6, respective references have a meaning mentioned below.

VS1: applying voltage during scan side selected
VS2: applying voltage during scan side non-selected
HZh: impedance of VS1 side on electrodes at scan side
HZl: impedance of VS2 side on electrodes at scan side
VD1; selected voltage at data side
VD2: non-selected voltage at data side
n1: selected number of electrode lines at data side (selected line)
n2: non-selected number of electrode lines at data side
V: voltage defined by time constant When t→∞

$$V=|VS1-VS2|\cdot HZl/(HZl+HZh)$$

Cp: cell capacitance of display panel (capacitor)

Figure 7:
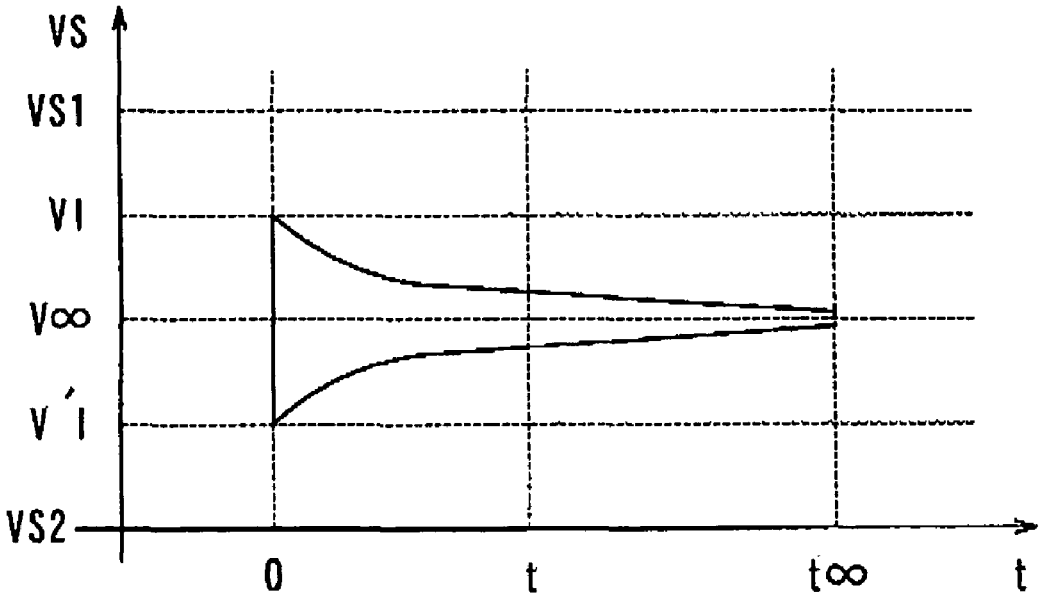
FIG. 7 is a schematic view explaining a high-impedance (HZ) state in a method of driving according to the invention.

Here, as shown in FIG. 7, if it is assumed that an initial voltage at t=0 is VI', the following equation is obtained.

$$VT=(n2/(n1+n2))\cdot(VD2-VD1)$$

This value comes close to V∞ at t=∞. However, it is necessary to become a high-impedance (HZ) value, which can maintain a certain contact voltage, till an instant t. A high-impedance connection state, which is equivalent to the open state, can be obtained from this high-impedance value.

As one example, a condition of VD2=80V and VD1=0V is discussed. In the case such that a panel capacitance is 10 nF (nano farad) and an applying time of pulse voltage VD2 is for example 1 ms, it is necessary to use a value larger than the following value so as to realize a condition such that a voltage (40V) applied to the non-selected pixel does not exceed a threshold voltage (45V):

$$HZ=(40(\mathrm{V})\times1\times10^{-3}(S))/((45-40)\times10\times10^{-9}(F))=800\ (\mathrm{k}\Omega)\approx1M(\Omega)$$

Here, this case is one example, and various alternations are possible.

Figure 8:
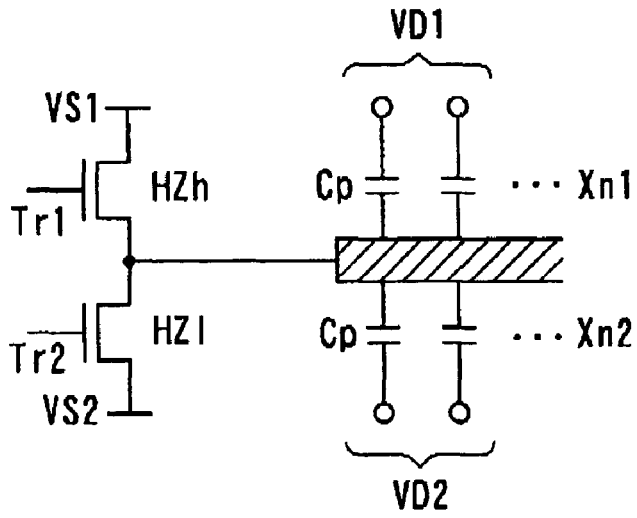
FIG. 8 is a schematic view explaining a high-impedance (HZ) state in a method of driving according to the invention.
Figure 9:
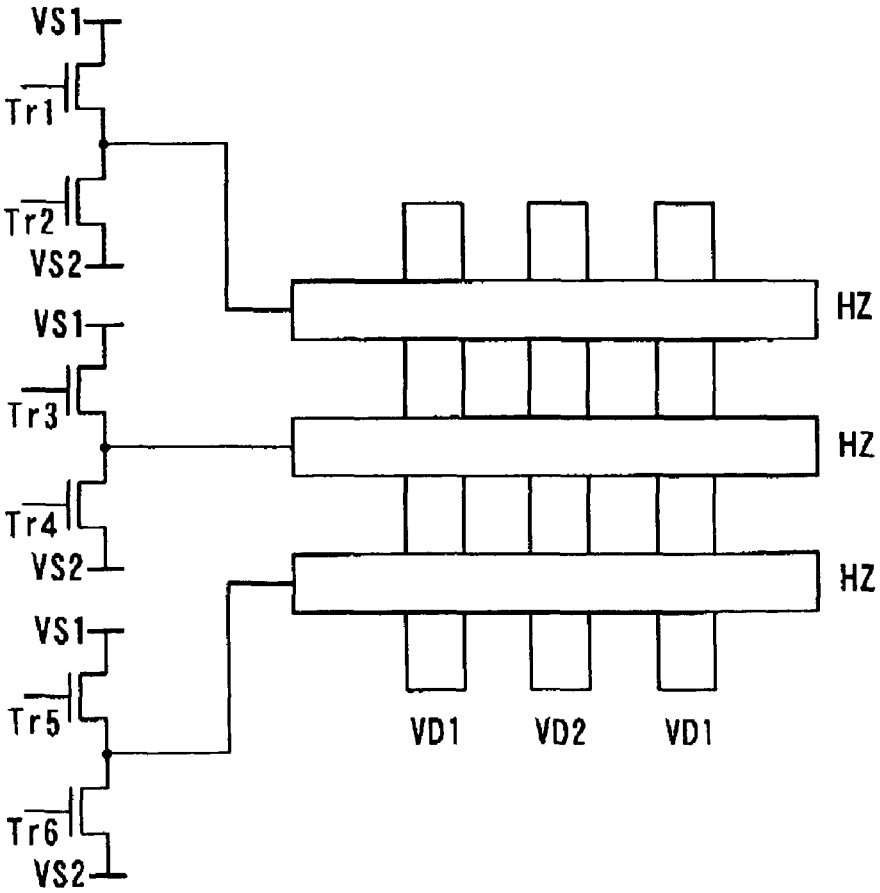
FIG. 9 is a schematic view explaining a high-impedance (HZ) state in a method of driving according to the invention.

FIG. 8 is a schematic view showing one embodiment, in which a high-impedance state is realized by output stages of driver ICs (Tr1, Tr2). If the driving according to the invention is performed in a circuit shown in FIG. 8, a connection state under high-impedance is realized, and thus it is possible to obtain the same effects as those of the open state. FIG. 9 is a schematic view illustrating one embodiment, in which a high-impedance state in a passive matrix driving is realized by a plurality of circuits each having the construction shown in FIG. 8 utilizing output stages of driver ICs (Tr1, Tr2, Tr3, Tr4, Tr5, Tr6). In this case, the same transistors may be used. In the embodiment shown in FIG. 9, the high-impedance state equivalent to the open state is realized by a connection using the transistors.

Figure 10:
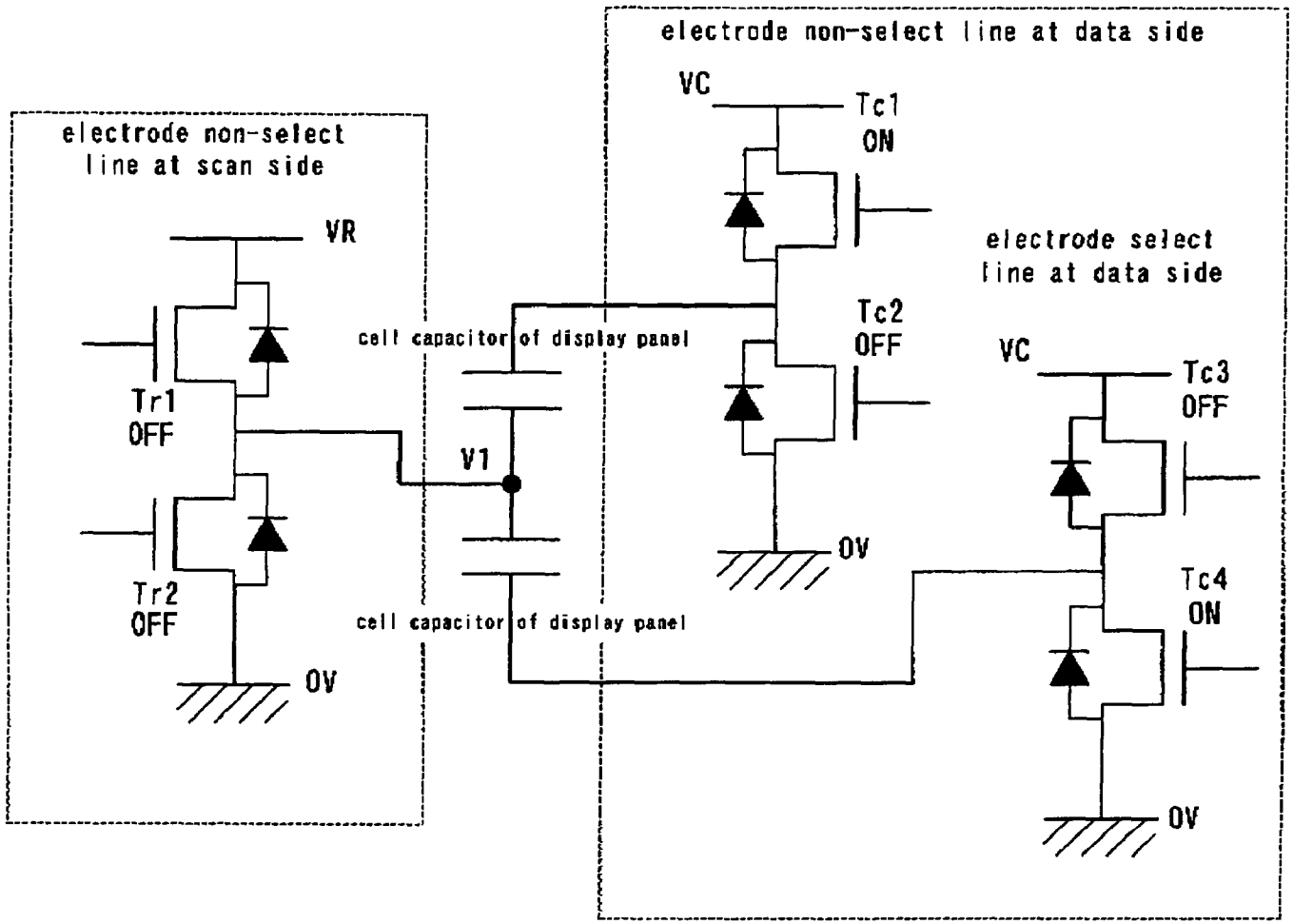
FIG. 10 is a schematic view explaining a high-impedance (HZ) state in a method of driving according to the invention.

FIG. 10 is a schematic view showing one embodiment of a driving circuit, in which the open state is realized by high-impedance of a display panel using the transistors. In the driving circuit utilizing the transistors (driver ICs), when the transistor Tr1 is OFF and the transistor Tr2 is OFF as shown in FIG. 10, all the connections of the electrodes at scan side are in the high-impedance state. This connection state is in the high-impedance sate equivalent to the open state in a switching circuit. For example, as shown in FIG. 10, if it is assumed that a voltage VR applied to the electrodes at row side (scan side) of the driving circuit utilizing transistors Tr1, Tr2, Tc1, Tc2, Tc3, Tc4 is VR=80V and a voltage VC applied to the electrodes at column side (data side) is VC=40V, a voltage V1 applied to the pixel electrodes of the display panel is V1=20V (in this case, it is assumed that cell capacitances of the display panels are same). In this case, the connection state of the non-selected electrode lines at scan side is in high-impedance. In order to realize this high-impedance state, use is made of the open state utilizing mechanical switches, output stage transistors of driver ICs, discrete semiconductors such as diodes, resistors and so on. The above voltage values are one example, and the other condition may be applied in the other case.

<As to Specific Driving Method>

Figure 11:
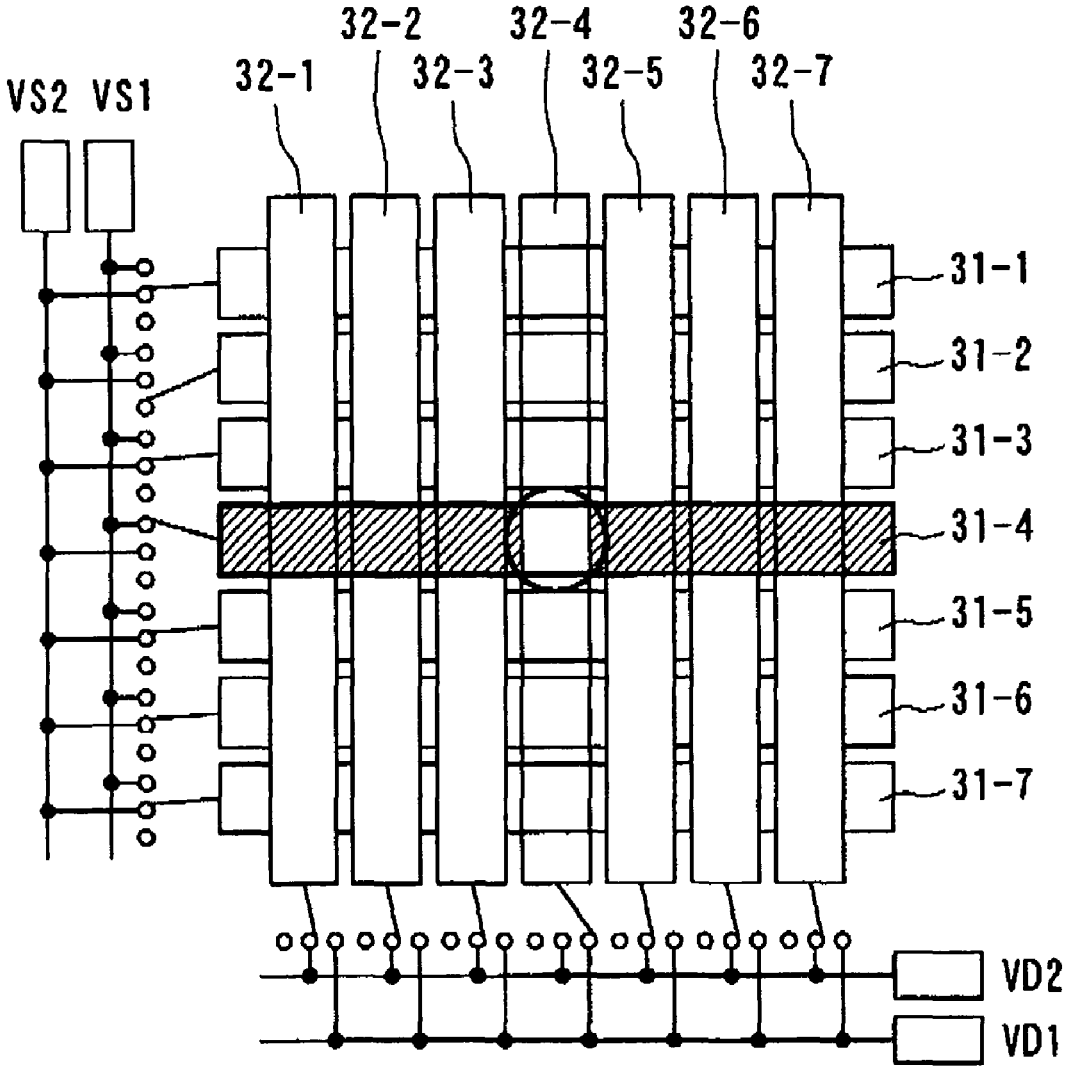
FIG. 11 is a schematic view explaining one embodiment of a method of driving the information display panel according to the invention.

FIG. 11 is a schematic view explaining one embodiment of a method of driving the information display panel according to the invention. In the embodiment shown in FIG. 11, numerals 31-1 to 31-7 are electrodes at scan side, and numerals 32-1 to 32-7 are electrodes at data side arranged in an intersecting direction (here, perpendicular) with respect to the electrodes 31-1 to 31-7 at scan side. In this embodiment, when information is displayed by scanning the electrodes 31-1 to 31-7 at scan side in its aligning direction according to a passive matrix driving, a predetermined voltage is applied respectively to the electrodes 31-1 to 31-7 at scan side and the electrodes 32-1 to 32-7 at data side, which construct a matrix electrode, so as to display information such as an image. In the embodiments shown in FIG. 11, the number of the electrodes at scan side and the number of the electrodes at data side are seven respectively. However, this is for a convenience of explanations, and these numbers of the electrodes at scan side and the electrodes at data side may be varied according to the necessary numbers of cells required for a display.

In the embodiment shown in FIG. 11 according to the invention, in the case such that information is displayed by scanning the electrodes 31-1 to 31-7 at scan side in its aligning direction, at first, a voltage of for example 0V is applied to the electrodes 31-1 to 31-7 at scan side and a voltage of for example 80V is applied to the electrode 32-1 to 32-7 at data side, so as to display overall black color. Then, a voltage VS1 is applied to the selected electrode 31-4 at scan side during writing, at least one non-selected electrode at scan side i.e. one non-selected electrode 31-2 at scan side is made to be in the open state, and a voltage VS2 is applied to the other non-selected electrodes 31-1, 31-3 and 31-5 to 31-7 at scan side. In addition, a voltage VD1 is applied to the selected electrode 32-4 at data side during writing, and a voltage VD2 (use may be made of arbitral different voltages with each other) is applied to the other non-selected electrodes 32-1 to 32-3 and 32-5 to 32-7 at data side. In this manner, information such as an image can be displayed. The open state here includes a connection under a high-impedance state.

Figure 12:
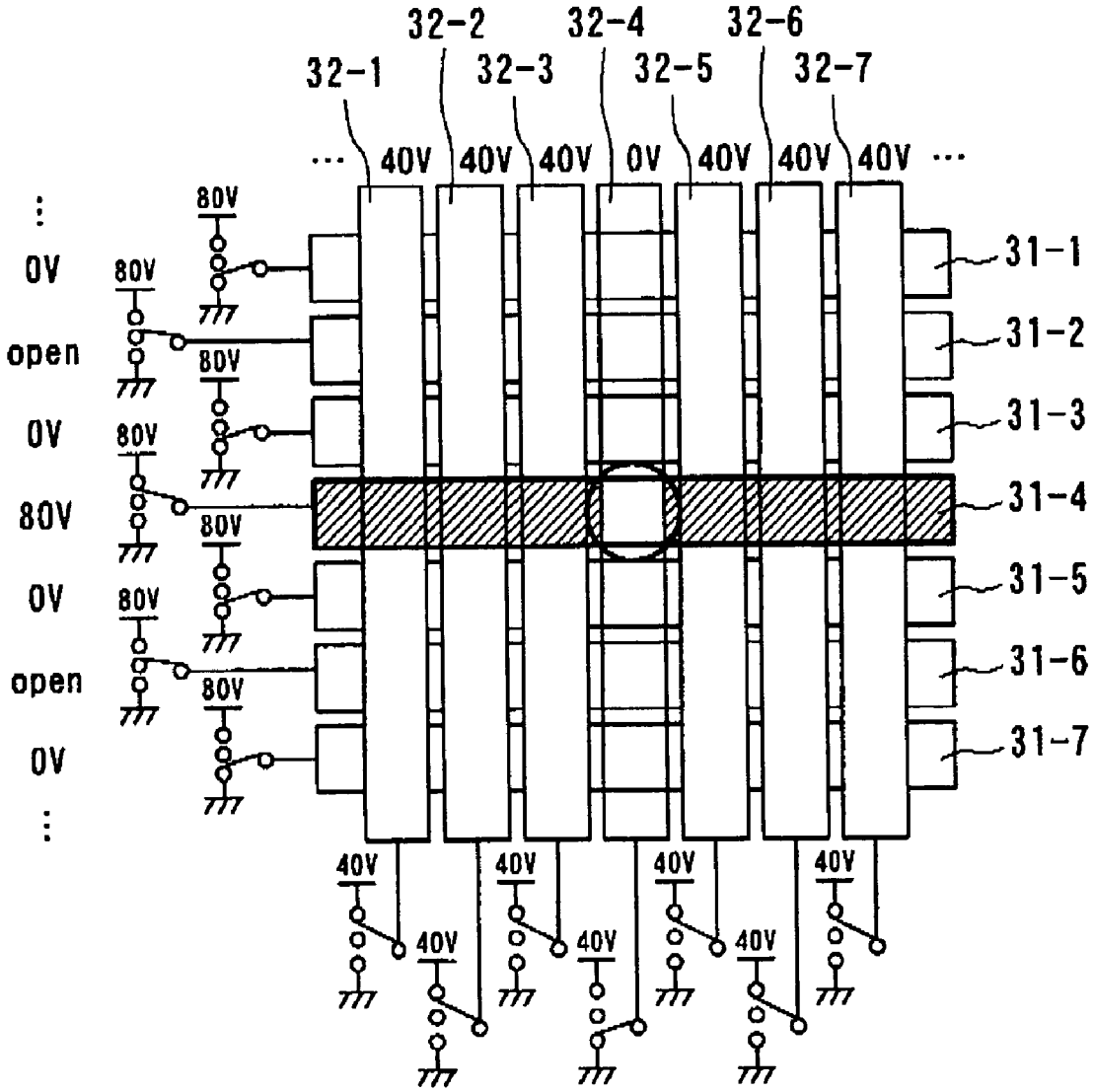
FIG. 12 is a schematic view explaining another embodiment of a method of driving the information display panel according to the invention.
Figure 13:
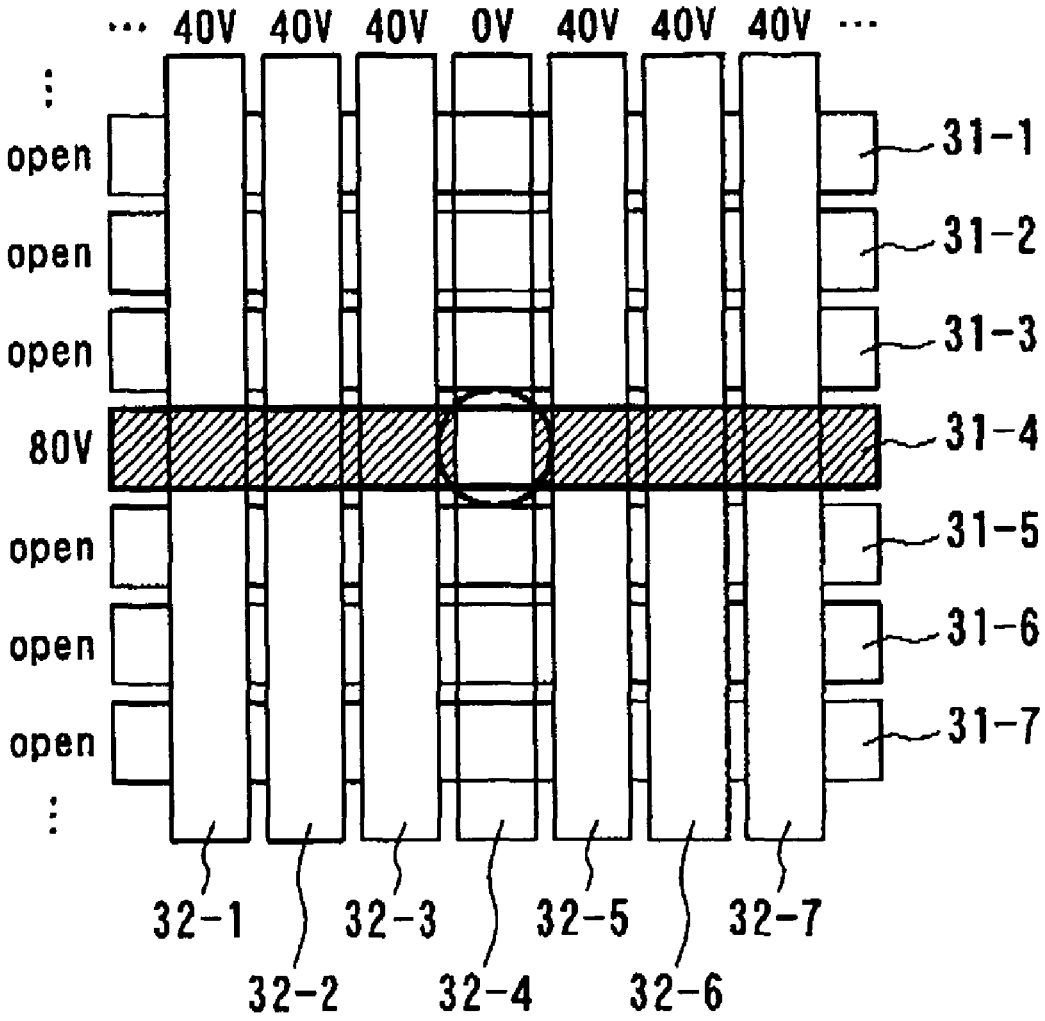
FIG. 13 is a schematic view explaining still another embodiment of a method of driving the information display panel according to the invention.

FIG. 12 and FIG. 13 are schematic views respectively explaining one specific embodiment of FIG. 11. In the embodiment shown in FIG. 12. VS1 is 80V, VS2 is 0V, VD1 is 0V and VD2 is 40V. In addition, two non-selected electrodes 31-2 and 31-6 at scan side are made to be in the open state. In the embodiment shown in FIG. 13, VS1 is 80V, VD1 is 0V and VD2 is 40V. In addition, all the non-selected electrodes 31-1 to 31-3 and 31-5 to 31-7 at scan side are made to be in the open state. The open state here includes a connection under a high-impedance state.

According to the invention mentioned above, in the case such that a voltage is applied between the electrodes 31-1 to 31-7 at scan side and the electrodes 32-1 to 32-7 at data side so as to drive the information display panel, at least one electrode among the non-selected electrodes 31-1 to 31-3 and 31-5 to 31-7 at scan side is made to be in the open state. Therefore, an influence of cross-talk can be reduced, and a display quality of the information display panel can be improved. Hereinafter, this reason will be explained.

Figure 14:
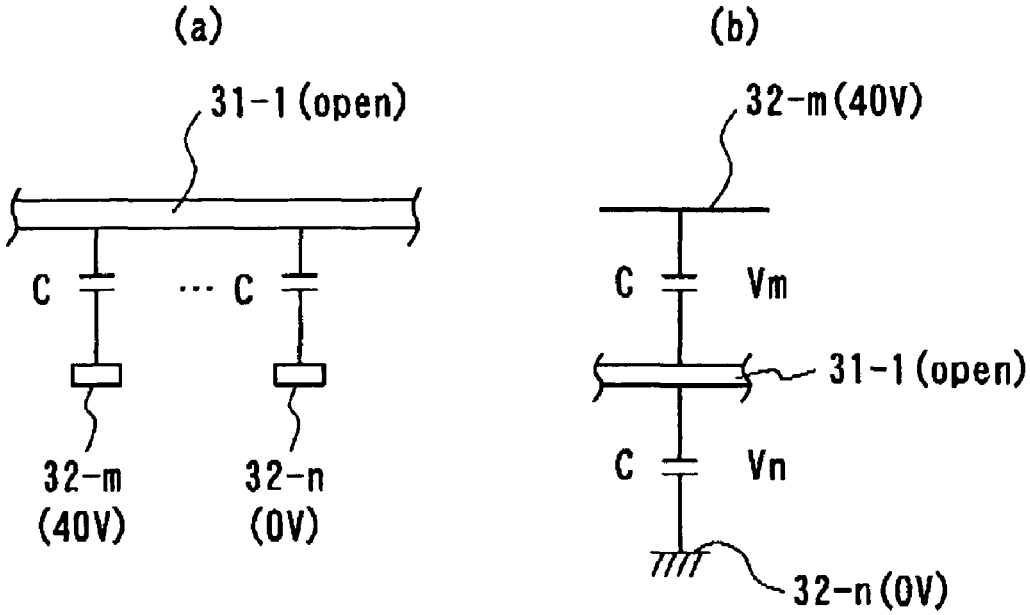
FIGS. 14*a* and 14*b* are schematic views respectively explaining the reason for reducing cross-talk in the invention.

FIGS. 14*a* and 14*b* are schematic views respectively explaining a reason for reducing cross-talk in the present invention. In the embodiment shown in FIGS. 14*a* and 14*b*, as one example, a relation between (1) the electrode 31-1 at scan side in the non-selected region that is not during writing (open state (including a connection state under a high-impedance state) and (2) the electrode 32-*m* at data side (40V) that is not contributed to writing and the electrode 32-*n* at data side (v: ground) that is contributed to writing is indicated. In this embodiment, since the electrode 31-1 at scan side is in the open state, a capacitor C between the electrode 31-1 at scan side and the electrode 32-*m* at data side and a capacitor C between the electrode 31-1 at scan side and the electrode 32-*n* at data side are connected in series between a potential 40V and a potential 0V (ground) as shown in FIG. 14*b*. Therefore, a voltage Vm between the electrode 31-1 at scan side and the electrode 32-*m* at data side and a voltage Vn between the electrode 31-1 at scan side and the electrode 32-*n* at data side become respectively 20V by dividing the voltage 40V. As a result, a cross-talk voltage can be reduced from 40V to 20V.

Figure 15:
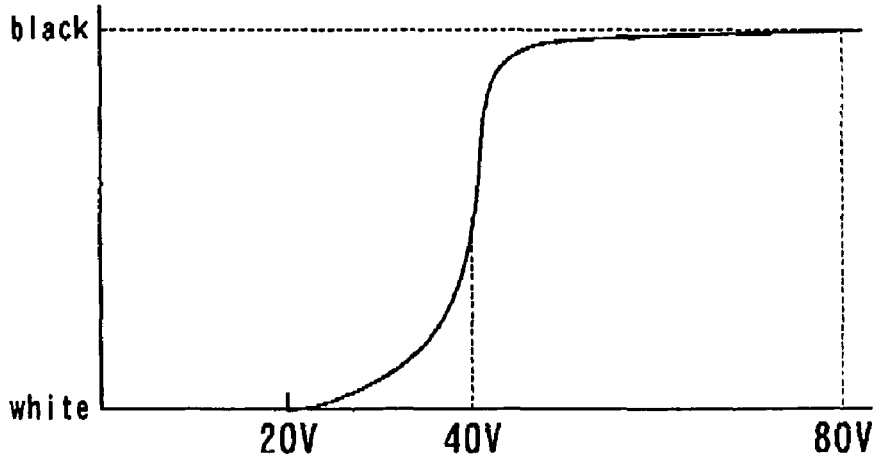
FIG. 15 is a graph showing a relation between voltage and color to be displayed in one embodiment according to the invention.

In the embodiment mentioned above, since the number of the electrodes at data side, to which 40V is applied, and the number of the electrodes at data side, to which 0V is applied, are respectively plural, the cross-talk voltage is only reduced from 40V to 20V even in a maximum (these numbers are same) case, and there is a case according to a writing condition such that the cross-talk voltage is not so reduced such as from 40V to for example 30V. Moreover, a voltage between the electrode 31-1 at scan side and the electrode 32-*n* at data side, whose cross-talk voltage is 0V, is varied from 0V to 20V. However, a moving property of the display media used in the present invention shows a hysteresis curve with respect to the applied voltage, as shown in FIG. 15, in which a white/black color variation is larger at near 40V. Therefore, even if the cross-talk voltage is reduced little from 40V, the cross-talk can be remarkably reduced. Moreover, if the cross-talk voltage is varied from 0V to 20V, since a voltage 20V is not in an abruptly varying region, an influence of the cross-talk can be made smaller. The open state here includes a connection under a high-impedance state.

In the embodiment mentioned above, voltages such as 0V, 40V, 80V applied to respective electrodes are one example, and they may be varied according to characteristics of the display media to be used. Moreover, a voltage 40V applied to the electrodes at data side in the non-selected region is a half of the driving voltage 80V, but this is also limited to a half value and a voltage other than a half value between 0V and 80V may be used according to the characteristics of the display media to be used. Further, in the embodiment mentioned above, all the non-selected electrodes at scan side are open (including a connection state under a high-impedance state). However, if at least one non-selected electrode at scan side is open (including a connection state under a high-impedance state), the present invention may be realized more or less. This high-impedance connection state can be easily realized by an equivalent circuit.

Figure 16:
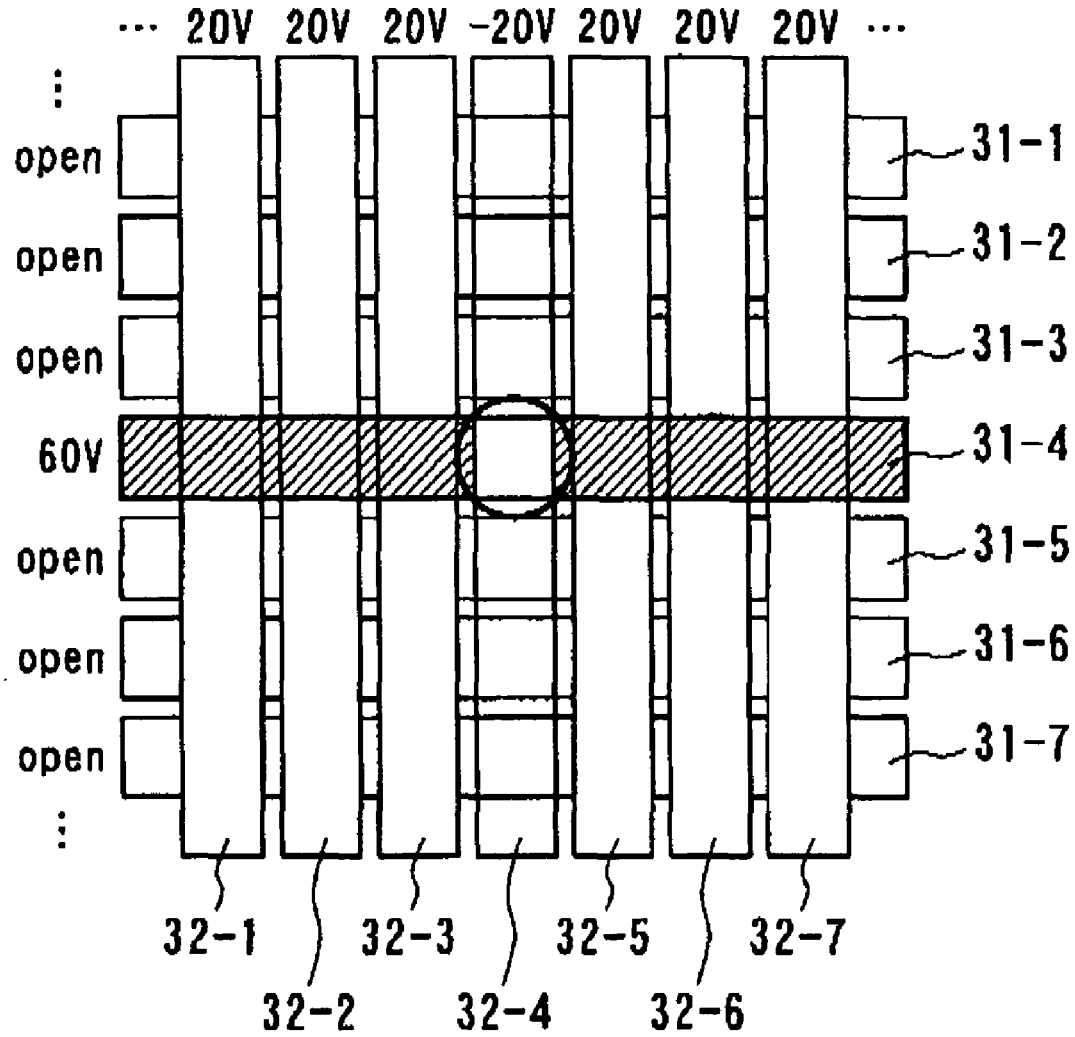
FIG. 16 is a schematic view explaining still another embodiment of a method of driving the information display panel according to the invention.
Figure 17:
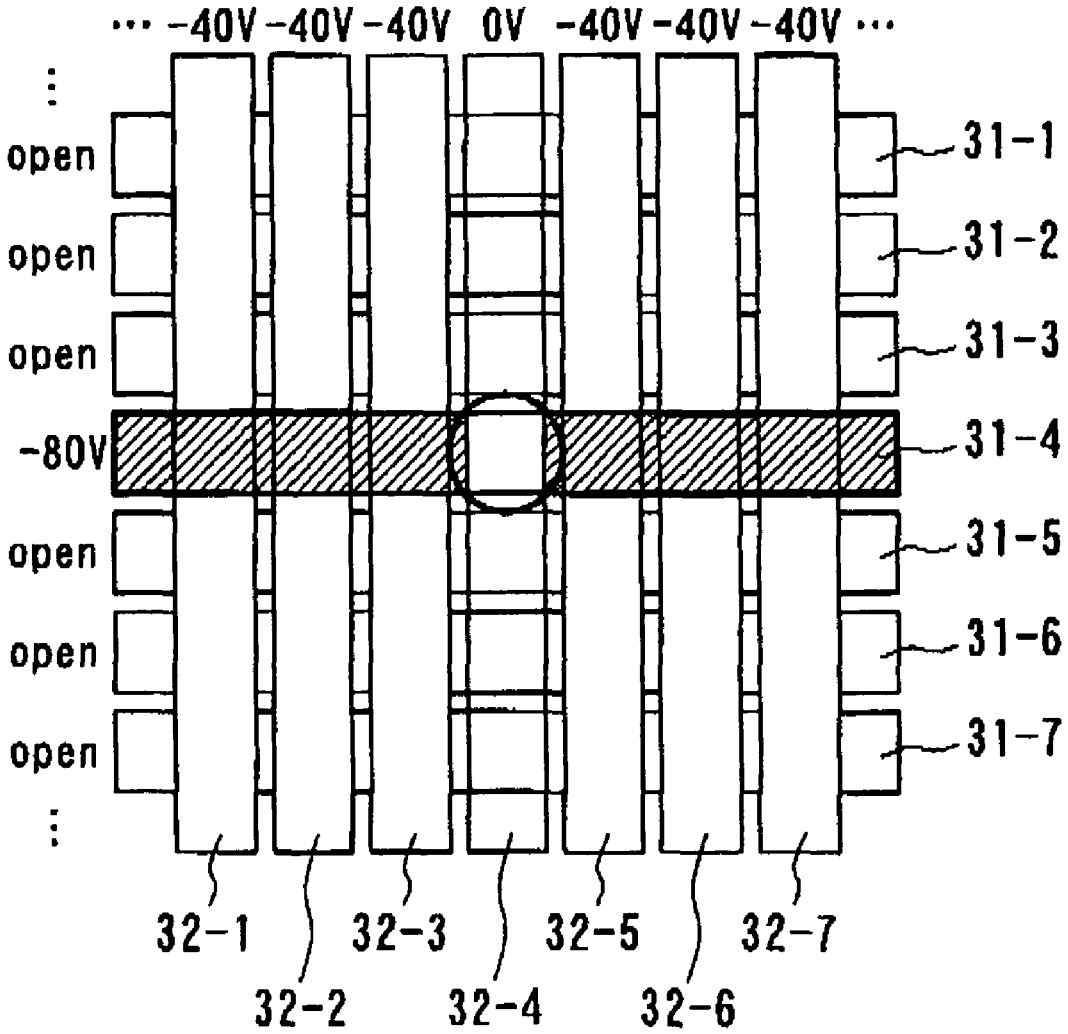
FIG. 17 is a schematic view explaining still another embodiment of a method of driving the information display panel according to the invention.

FIG. 16 and FIG. 17 are schematic views respectively explaining another embodiment of a method of driving the information display panel according to the invention. In the embodiments shown in FIG. 16 and FIG. 17, reference numerals similar to those of FIG. 13 are denoted by the same reference numerals as those of FIG. 13, and the explanation thereof is omitted here. In the embodiments shown in FIG. 16 and FIG. 17, a difference point from FIG. 13 is on a method of applying a voltage to respective electrode during information writing. That is, in the embodiment shown in FIG. 16, a voltage of 60V is applied to the selected electrode 31-4 at scan side, a voltage of −20V is applied to the selected electrode 32-4 at data side, and a voltage of 20V is applied to the non-selected electrodes 32-1 to 32-3 and 32-5 to 32-7 at data side. Moreover, in the embodiment shown in FIG. 17, a voltage of −80V is applied to the selected electrode 31-4 at scan side, a voltage of 0V is applied to the selected electrode 32-4 at data side, and a voltage of −40V is applied to the non-selected electrodes 32-1 to 32-3 and 32-5 to 32-7 at data side. In both embodiments, a potential difference of 80V is generated between the selected electrode 31-4 at scan side and the selected electrode 32-4 at data side during information writing, and a potential difference of 40V is generated between the selected electrode 31-4 at scan side and the non-selected electrodes 32-1 to 32-3 and 32-5 and 32-7 at data side, so that the same driving as that of the present invention shown in FIG. 13.

Features of the second aspect of the invention lie on a method of driving the information display panel, in which display media are sealed in a space between two substrates, at least one substrate being transparent, and, in which an electrostatic field, which is generated from an electrode at scan side and an electrode at data side arranged respectively to the opposed substrates in an intersected manner, is applied to the display media so as to display information such as an image, having a construction such that at least two or more voltage values or an open state (including a connection state under a high-impedance state) are applied to at least one electrode, and a dummy electrode is formed at a portion other than an information rewriting portion.

Specifically, a capacitance of a sum of cells formed by the dummy electrodes arranged other than the information rewriting portion is 1/3 or more, preferably 1/2 or more, 1/1 or more and more than the above of a capacitance of a sum of cells formed by the electrodes arranged to the information rewriting portion (a larger capacitance is no problem, but a region of the dummy electrodes becomes larger and thus a problem on space arises). If a capacitance of the dummy electrodes is controlled as mentioned above, it is possible to perform the present invention more effectively. As a method of making a capacitance of the dummy electrodes larger, use is made of a method: such that an area of the electrodes is made larger; such that a material having a high dielectric constant is filled; and such that a gap between the electrodes is made smaller.

Moreover, specifically, in the case such that: an applying voltage of the selected electrode at scan side is VS1; at least one electrode among the non-selected electrodes at scan side is, open (including a connection state under a high-impedance state); an applying voltage of the selected electrode at data side is VD1; at least one electrode among the non-selected electrode at data side is open (including a connection state under a high-impedance state); and an applying voltage of the other non-selected electrode at data side is VD2; when the dummy electrode is formed with respect to the electrode at data side, a voltage is applied to the dummy electrode according to the number of the electrodes to which VD1 is applied, the number of the electrodes to which VD2 is applied, and the number of the electrodes which are an open state. In this embodiment, an effect of the dummy electrodes may be improved, and thus it is possible to perform the present invention more preferably.

Further, the open state may realize a connection state under a high-impedance state. As a method of obtaining a connection state under high-impedance, there is for example a method utilizing a power supply changing apparatus, a voltage changing-over switch, an output stage changing by means of driver IC and so on, and among them a connection utilizing transistors is preferably used.

Furthermore, it is preferred that use is made of the information display panel, in which at least one group of the display media having optical reflectance and charge characteristics, formed by at least one group of particles, are sealed in the space between two substrates, at least one substrate being transparent. However, the present invention may be effective for the display media of a voltage driving type such as a liquid crystal, an electrophoresis and two-colored rotation ball other than the particles.

Figure 18:
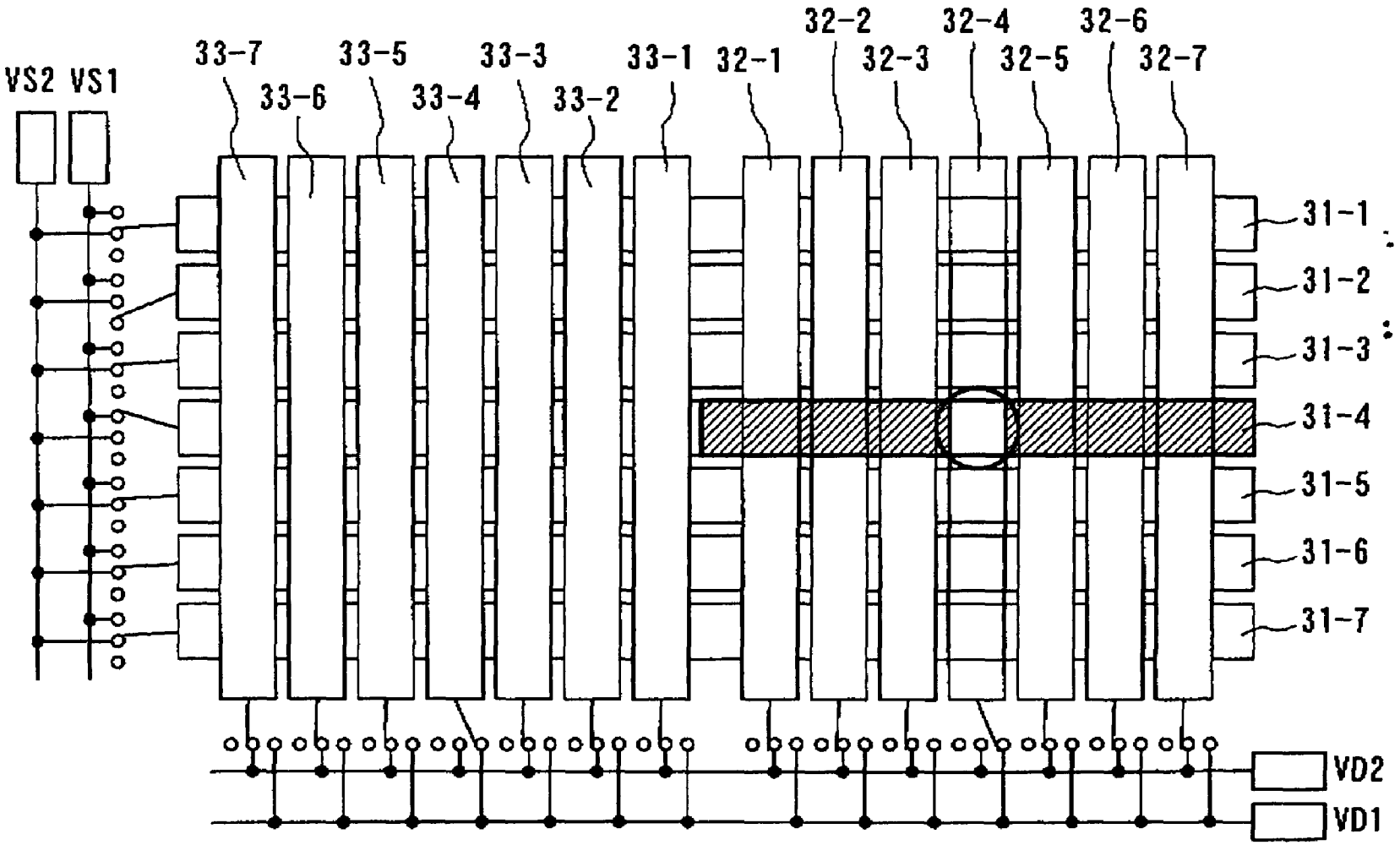
FIG. 18 is a schematic view explaining still another embodiment of a method of driving the information display panel according to the invention.

FIG. 18 is a schematic view showing still another embodiment of a method of driving the information display panel according to the invention. In the embodiment shown in FIG. 18, numerals 31-1 to 31-7 are electrodes at scan side, numerals 32-1 to 32-7 are electrodes at data side arranged in a perpendicular direction with respect to the electrodes 31-1 to 31-7 at scan side, and numerals 33-1 to 33-7 are dummy electrodes at data side arranged continuously to the electrodes 32-1 to 32-7 at data side in a region other than information display region 34. In this embodiment, when information is displayed by scanning the electrodes 31-1 to 31-7 at scan side in its aligning direction, a predetermined voltage is applied respectively to the electrodes 31-1 to 31-7 at scan side and the electrodes 32-1 to 32-7 at data side, which construct a matrix electrode, and a predetermined voltage is applied to the dummy electrodes 33-1 to 33-7 at data side, so as to display information such as an image. In the embodiment shown in FIG. 18, the number of the electrodes at scan side and the number of the electrodes at data side are seven respectively. However, this is for a convenience of explanations, and these numbers of the electrodes at scan side and the electrodes at data side may be varied according to the necessary numbers of cells required for a display. Moreover, the number of the dummy electrodes 33-1 to 33-7 at data side is not limited to the above number.

In the embodiment shown in FIG. 18 according to the invention, in the case such that information is displayed by scanning the electrodes 31-1 to 31-7 at scan side in its aligning direction, at first, a voltage of for example 0V is applied to the electrodes 31-1 to 31-7 at scan side and a voltage of for example 80V is applied to the electrode 32-1 to 32-7 at data side, so as to display overall black color. Then, a voltage VS1 is applied to the selected electrode 31-4 at scan side during writing, at least one non-selected electrode at scan side i.e. one non-selected electrode 31-2 at scan side is made to be in the open state (including a connection state under a high-impedance state), and a voltage VS2 is applied to the other non-selected electrodes 31-1, 31-3 and 31-5 to 31-7 at scan side. In addition, a voltage VD1 is applied to the selected electrode 32-4 at data side during writing, and a voltage VD2 is applied to the other non-selected electrodes 32-1 to 32-3 and 32-5 to 32-7 at data side. In this manner, information such as an image can be displayed. At the same time, a voltage of VD2 or a voltage of VD1 is applied to the dummy electrodes 33-1 to 33-7 according to the numbers of the selected electrodes at data side and the non-selected electrodes at data side. In the preferred embodiment shown in FIG. 18, there is disclosed a case such that the number of the electrodes at data side and the number of the dummy electrodes at data side are same, in which a voltage of VD2 is applied to the dummy electrodes at data side, the number of which is the same as the number of the selected electrodes at data side, and a voltage VD1 is applied to the dummy electrodes at data side, the number of which is the same as the number of the non-selected electrodes at data side.

Figure 19:
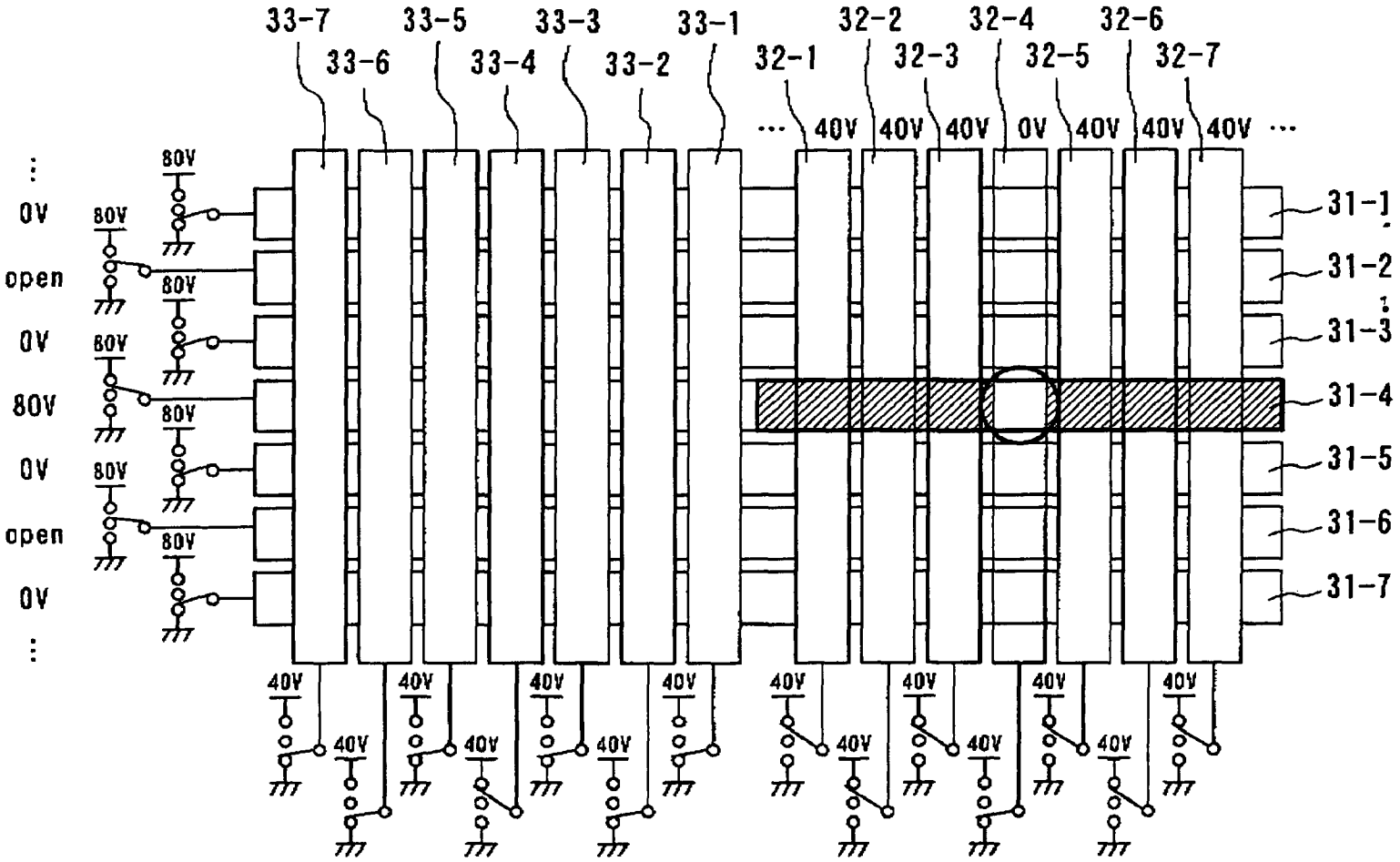
FIG. 19 is a schematic view explaining still another embodiment of a method of driving the information display panel according to the invention.
Figure 20:
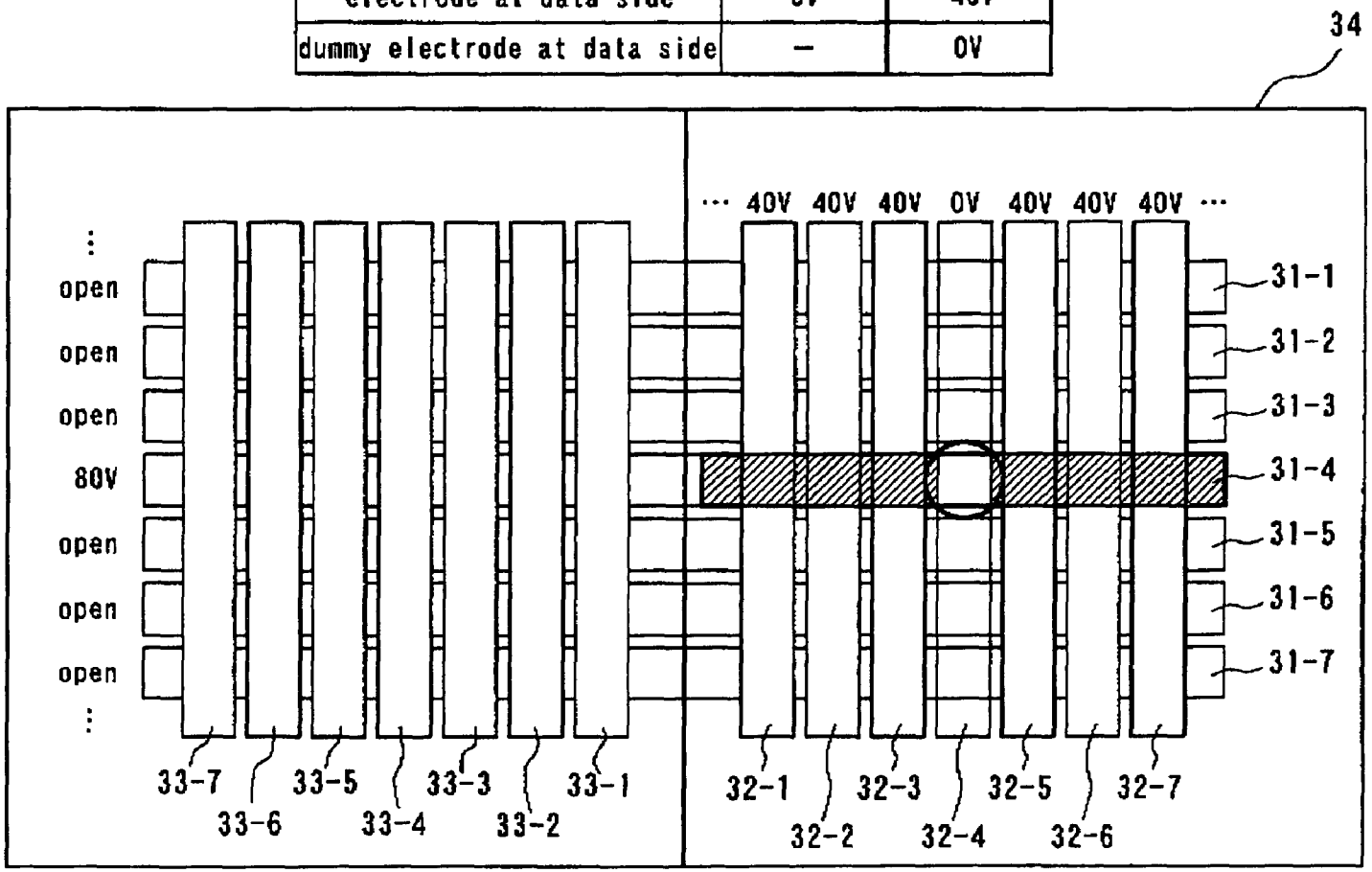
FIG. 20 is a schematic view explaining still another embodiment of a method of driving the information display panel according to the invention.

FIG. 19 and FIG. 20 are schematic views respectively explaining one specific embodiment of FIG. 18. In the embodiment shown in FIG. 19, VS1 is 80V, VS2 is 0V, VD1 is 0V and VD2 is 40V. In addition, two non-selected electrodes 31-2 and 31-6 at scan side are made to be in the open state (including a connection state under a high-impedance state). In the embodiment shown in FIG. 20, VS1 is 80V, VS1 is 0V and VD2 is 40V. In addition, all the non-selected electrodes 31-1 to 31-3 and 31-5 to 31-7 at scan side are made to be in the open state (including a connection state under a high-impedance state). In a table shown in FIG. 20, a reference (–) is indicated at a selected portion of the dummy electrode at data side. This means that there is no selected dummy electrode at data side among the dummy electrodes 33-1 to 33-7 at data side. In the embodiments mentioned above, a part of the non-selected electrodes at scan side is made to be open, but a part of the non-selected electrodes at data side may be made to be open. In this case, it is possible to reduce the number of the dummy electrodes at data side.

According to the invention mentioned above, in the case such that a voltage is applied between the electrodes 31-1 to 31-7 at scan side and the electrodes 32-1 to 32-7 at data side so as to drive the information display panel, at least one electrode among the non-selected electrodes 31-1 to 31-3 and 31-5 to 31-7 at scan side is made to be in the open state (including a connection state under a high-impedance state), and a voltage of VD1 or VD2 is applied to the dummy electrodes 33-1 to 33-7 at data side. Therefore, an influence of cross-talk can be reduced, and a display quality of the information display panel can be improved.

In this embodiment, in addition to the effect obtained from the state such that the non-selected electrodes 31-1 to 31-3 and 31-5 to 31-7 at scan side is made to be open (including a connection state under a high-impedance state), the following effect can be obtained. That is, since the dummy electrodes 33-1 to 33-7 at data side are arranged outside of the information display portion 34 and a voltage of 0V is applied to the dummy electrode 33-1 to 33-7 at data side, a voltage is further divided in the capacitor calculation mentioned above, so that a voltage applied to the electrodes 32-1 to 32-7 at data side and the dummy electrodes 33-1 to 33-7 at data side is made smaller than 20V. As a result, the cross-talk voltage can be varied from 40V to smaller than 20V for example 10V.

In the embodiment mentioned above, since the number of the electrodes at data side, to which 40V is applied, and the number of the electrodes at data side, to which 0V is applied, are respectively plural, there is a case according to a distribution of the number of the electrode and a writing condition such that the cross-talk voltage is not so reduced such as from 40V to for example 30V. Moreover, a voltage V4 between the electrode 31-1 at scan side and the electrode 32-4 at data side, whose cross-talk voltage is 0V, is varied from 0V to 20V. However, a moving property of the display media used in the present invention shows a hysteresis curve with respect to the applied voltage, as shown in FIG. 15, in which a white/black color variation is larger at near 40V. Therefore, even if the cross-talk voltage is reduced little from 40V, the cross-talk can be remarkably reduced. Moreover, if the cross-talk voltage is varied from 0V to 20V, since a voltage 20V is not in an abruptly varying region, an influence of the cross-talk can be made smaller. The open state here includes a connection under a high-impedance state.

In the embodiment mentioned above, voltages such as 0V, 40V, 80V applied to respective electrodes are one example, and they may be varied according to characteristics of the display media to be used. Moreover, a voltage 40V applied to the electrodes at data side in the non-selected region is a half of the driving voltage 80V, but this is also limited to a half value and a voltage other than a half value between 0V and 80V may be used according to the characteristics of the display media to be used. Further, a voltage 0V applied to the dummy electrode at data side is not limited, but use may be made of the other voltage or the open state (including a connection state under a high-impedance state). In this case, in the case of applying the voltage, if a voltage larger than 40V applied to the electrodes at data side in the non-selected region is applied, the cross-talk voltage cannot be reduced due to the divided voltage and is rather increased. Therefore, it is preferred to use a voltage other than 0V between 0V and 40V. Furthermore, in the embodiment mentioned above, all the non-selected electrodes at scan side are open (including a connection state under a high-impedance state). However, if at least one non-selected electrode at scan side is open (including a connection state under a high-impedance state), the present invention may be realized more or less.

Figure 21:
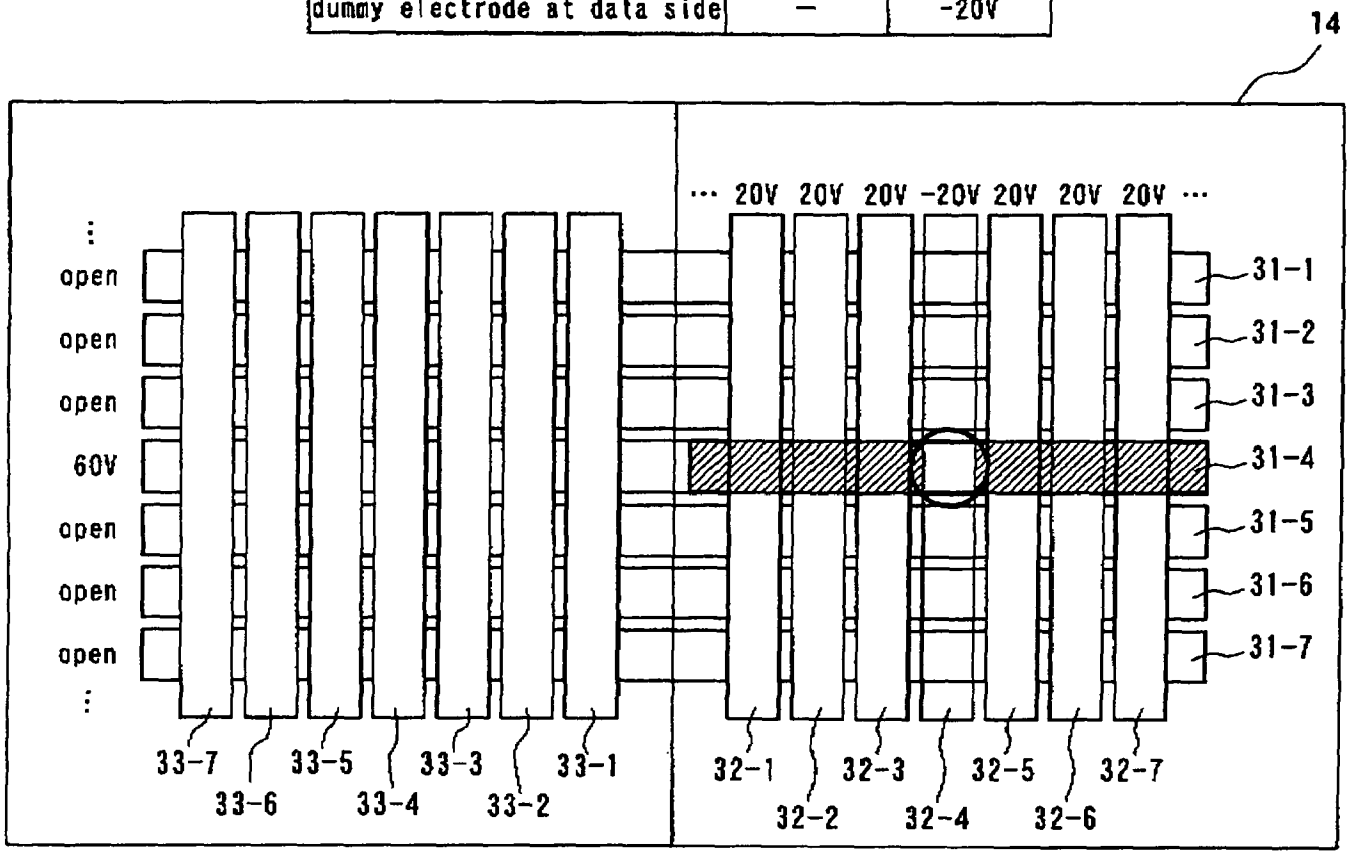
FIG. 21 is a schematic view explaining still another embodiment of a method of driving the information display panel according to the invention.
Figure 22:
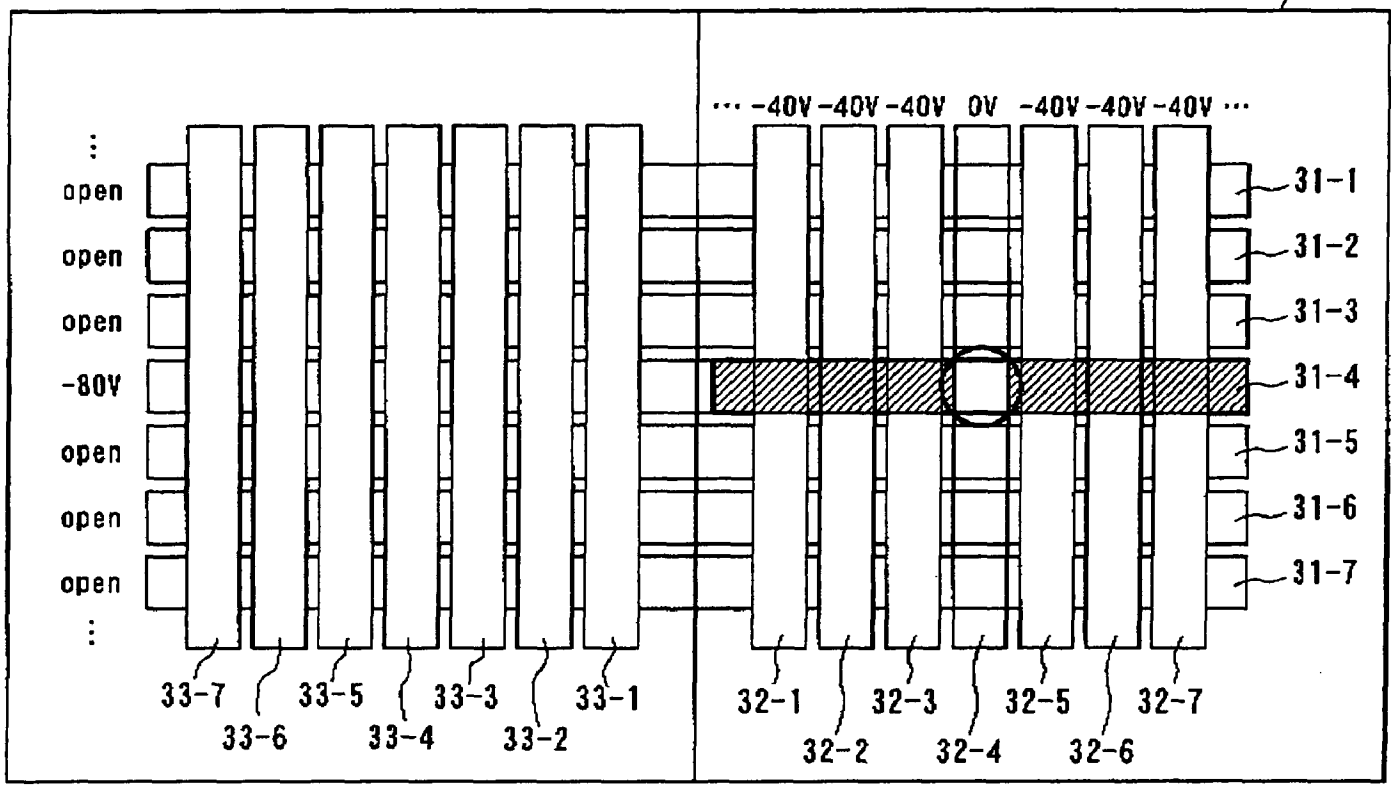
FIG. 22 is a schematic view explaining still another embodiment of a method of driving the information display panel according to the invention.

FIG. 21 and FIG. 22 are schematic views respectively explaining another embodiment of a method of driving the information display panel according to the invention. In the embodiments shown in FIG. 21 and FIG. 22, reference numerals similar to those of FIG. 20 are denoted by the same reference numerals as those of FIG. 20, and the explanation thereof is omitted here. In the embodiments shown in FIG. 21 and FIG. 22, a difference point from FIG. 20 is on a method of applying a voltage to respective electrode during information writing. That is, in the embodiment shown in FIG. 21, a voltage of 60V is applied to the selected electrode 31-4 at scan side, a voltage of −20V is applied to the selected electrode 32-4 at data side, and a voltage of 20V is applied to the non-selected electrodes 32-1 to 32-3 and 32-5 to 32-7 at data side. Moreover, in the embodiment shown in FIG. 22, a voltage of −80V is applied to the selected electrode 31-4 at scan side, a voltage of 0V is applied to the selected electrode 32-4 at data side, and a voltage of −40V is applied to the non-selected electrodes 32-1 to 32-3 and 32-5 to 32-7 at data side. In both embodiments, a potential difference of 80V is generated between the selected electrode 31-4 at scan side and the selected electrode 32-4 at data side during information writing, and a potential difference of 40V is generated between the selected electrode 31-4 at scan side and the non-selected electrodes 32-1 to 32-3 and 32-5 and 32-7 at data side, so that the same driving as that of the present invention shown in FIG. 20.

Figure 23:
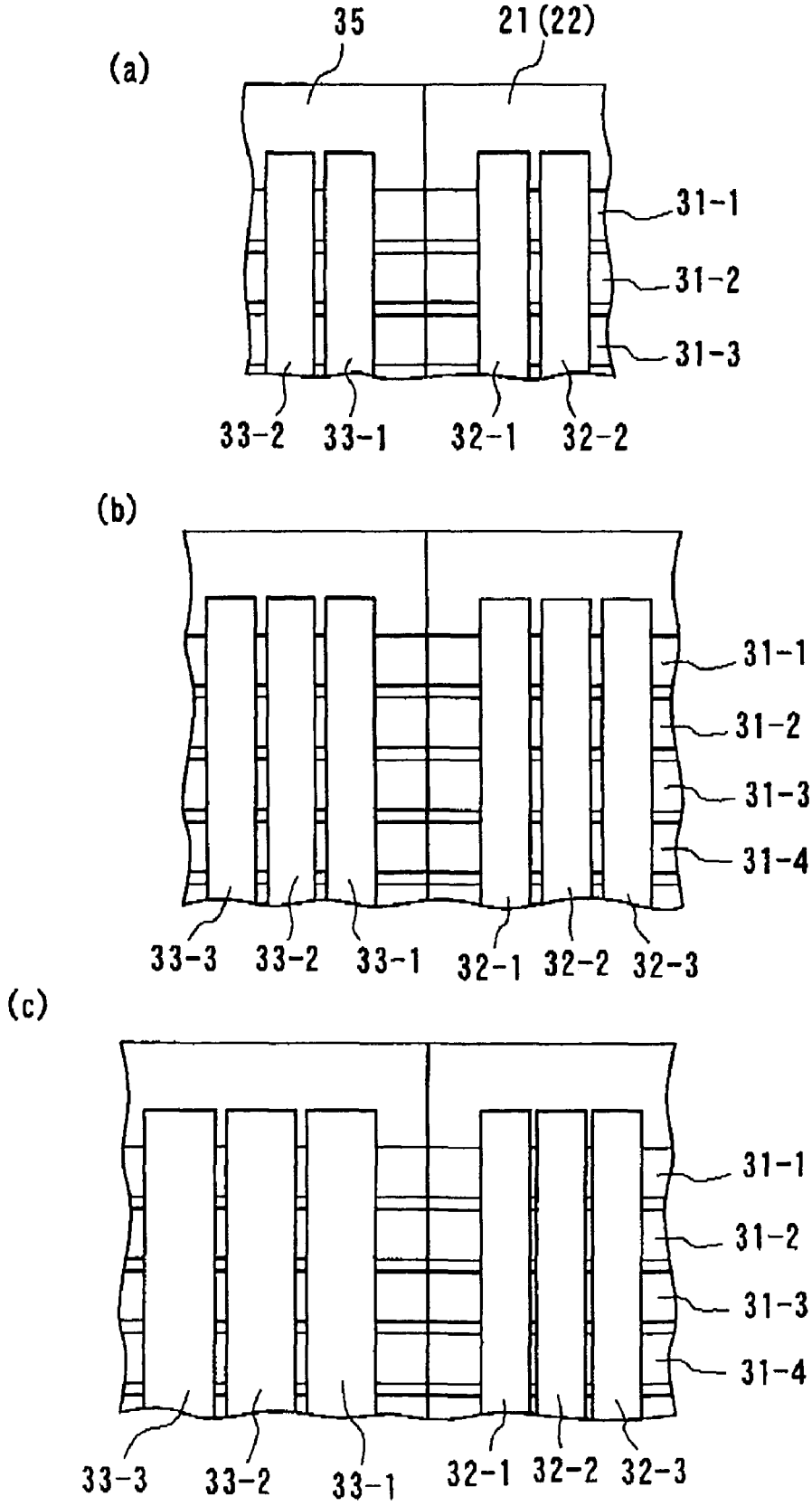
FIGS. 23*a*-23*c* are schematic views respectively explaining a preferred embodiment of a method of driving the information display panel according to the invention.

FIGS. 23*a* to 23*c* are schematic views respectively explaining a preferred embodiment of a method of driving the information display panel according to the invention. All the embodiments shown in FIGS. 23*a* to 23*c* indicate respectively a construction such that a region, in which the dummy electrodes at data side (here, 33-1 and 33-2 are shown as one example) arranged continuously to the electrodes at data side and outside of the information display portion 34, has a high dielectric constant. That is, in the embodiment shown in FIG. 23*a*, the above high dielectric constant is achieved by selecting a material of a substrate 35 supporting the dummy electrodes 33-1, 33-2 at data side (for example, using a material having a high dielectric constant or adding an additive for increasing a dielectric constant). In the embodiment shown in FIG. 23*b*, the above high dielectric constant is achieved by making an interval between the dummy electrodes 33-1 and 33-2 at data side narrower than an interval between the electrodes at data side in the information display portion 34. In the embodiment shown in FIG. 23*c*, the above high dielectric constant is achieved by making a width of the dummy electrodes 33-1, 33-2 at data side wider than a width of the electrodes at data side in the information display portion 34.

In the embodiments shown in FIGS. 23*a* to 23*c*, the drawback such that, since it is necessary to use a region for arranging the dummy electrodes at data side, overall panel becomes larger than the known information display panel, can be preferably eliminated by reducing an area for the dummy electrodes at data side, in which dielectric constant is made higher.

Hereinafter, respective members constituting the information display panel, which is an object of the invention, will be explained.

As for the substrate, at least one of the substrates is the transparent substrate 2 through which a color of the display media 3 can be observed from outside of the information display panel, and it is preferred to use a material having a high transmission factor of visible light and an excellent heat resistance. The substrate 1 may be transparent or opaque.

Examples of the substrate material include polymer sheets such as polyethylene terephthalate, polyethylene naphthalate, polyether sulfone, polyethylene, polycarbonate, polyimide or acryl and metal sheets having flexibility and inorganic sheets such as glass, quartz or the like having no flexibility. The thickness of the substrate is preferably 2 to 5000 μm, more preferably 5 to 2000 μm. When the thickness is too thin, it becomes difficult to maintain strength and distance uniformity between the substrates, and when the thickness is thicker than 5000 μm, it is inconvenient for the thin information display panel.

As for materials for forming the electrodes or conductive members provided if necessary, metals Such as aluminum, silver, nickel, copper, gold and so on, conductive metal oxides such as indium tin oxide (ITO), antimony tin oxide (ATO), indium oxide, conductive tin oxide and conductive zinc oxide and so on, and conductive polymer such as polyaniline, polypyrrole, polythiophene and so on are listed and appropriately used. As the method for forming the electrode, the pattern forming method in which a thin film is formed from the above-listed materials by sputtering method, vacuum vapor deposition method, CVD (chemical vapor deposition) method, and coating method, or the pattern forming method in which the mixed solution of an conductive agent with a solvent or a synthetic resin binder is applied, are used. The electrode or conductive member disposed on the substrate at the observation side (display side) should be transparent but the electrode or conductive member disposed on the back substrate may not be transparent. In both cases, above-mentioned conductive material capable of pattern forming can be preferably used. Additionally, the thickness of the electrode or conductive member is preferable to be 3 to 1000 nm, more preferable to be 5 to 400 nm so that the electro-conductivity and optical transparency can be maintained. The material and the thickness of the electrode arranged on the back substrate are similar to those of the electrode or conductive member arranged at the display side, but transparency is not necessary. In this case, the applied outer voltage may be superimposed with a direct current or an alternate current.

As for the partition wall 4 provided, a shape of the partition wall is suitably designed in accordance with a kind of the display media used for the display, a shape of disposed electrodes and a disposition and is not restricted. It is preferred to set a width of the partition wall to 2-100 μm more preferably 3-50 μm and to set a height of the partition wall to 10-100 μm more preferably 10-50 μm.

Moreover, there are a double rib method and single rib method as a method of forming the partition wall on the opposed substrates 1 and 2. In the double rib method ribs are formed on the opposed substrates respectively and then connected with each other. In the single rib method a rib is formed on one of the opposed substrates only. Both methods mentioned above may be preferably applied to the present invention.

Figure 24:
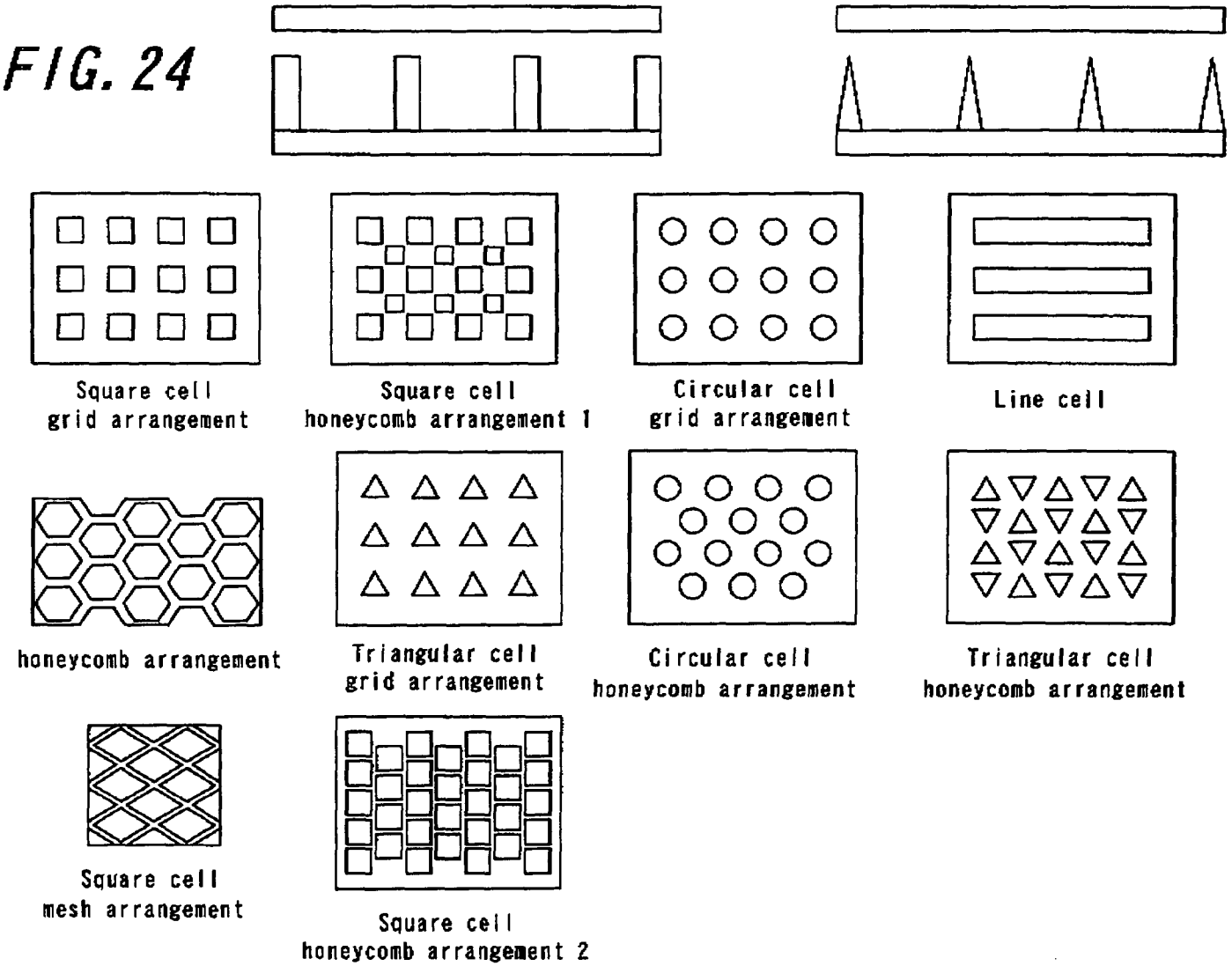
FIG. 24 is a schematic view illustrating one embodiment of a shape of the partition walls in the information display panel according the invention.

The cell formed by the partition walls each made of rib has a square shape, a triangular shape, a line shape, a circular shape and a hexagon shape, and has an arrangement such as a grid, a honeycomb and a mesh, as shown in FIG. 24 viewed from a plane surface of the substrate. It is preferred that the portion corresponding to a cross section of the partition wall observed from the display side (an area of the frame portion of the display cell) should be made as small as possible, so that sharpness of the image display can be improved.

As the formation method of the partition wall there are a die transferring method, a screen-printing method, a sandblast method, a photolithography method and an additive method. Any methods can be preferably used in the information display panel of this invention. Among them, it is preferred to use a photolithography method using a resist film and a die transferring method.

Then, the liquid powders for example used as the display media in the information display panel according to the present invention will be explained. The applicant has the right of the name of the liquid powders utilized in the information display panel of the present invention as "electric liquid powders (trade mark): registration number 4636931".

In the present invention, a term "liquid powders" means an intermediate material having both of liquid properties and particle properties and exhibiting a self-fluidity without utilizing gas force and liquid force. For example, a liquid crystal is defined as an intermediate phase between a liquid and a solid, and has a fluidity showing a liquid characteristic and an anisotropy (optical property) showing a solid characteristic (Heibonsha Ltd.: encyclopedia). On the other hand, a definition of the particle is a material having a finite mass even if it is vanishingly small and receives an attraction of gravity (Maruzen Co., Ltd.: physics subject-book). Here, even in the particles, there are special states such as gas-solid fluidized body and liquid-solid fluidized body. If a gas is flown from a bottom plate to the particles, an upper force is acted with respect to the particles in response to a gas speed. In this case, the gas-solid fluidized body means a state that is easily fluidized when the upper force is balanced with the gravity. In the same manner, the liquid-solid fluidized body means a state that is fluidized by a liquid. (Heibonsha Ltd.: encyclopedia) In the present invention, it is found that the intermediate material having both of fluid properties and solid properties and exhibiting a self-fluidity without utilizing gas force and liquid force can be produced specifically, and this is defined as the liquid powders.

That is, as is the same as the definition of the liquid crystal (intermediate phase between a liquid and a solid), the liquid powder according to the invention is a material showing the intermediate state having both of liquid properties and particle properties, which is extremely difficult to receive an influence of the gravity showing the particle properties mentioned above and indicates a high fluidity. Such a material can be obtained in an aerosol state i.e. in a dispersion system wherein a solid-like or a liquid-like material is floating in a relatively stable manner as a dispersant in a gas, and thus, in the information display panel according to the invention, a solid material is used as a dispersant.

In the information display panel of the present invention, the liquid powders composed of a solid material stably floating as a dispersant for example in a gas and exhibiting a high fluidity in an aerosol state are sealed between two opposed substrates, at least one substrate being transparent. Such liquid powders are too fluid to measure its repose angle, which is an index indicating fluidity of powders and can be made to move easily and stably by means of Coulomb's force and so on generated by applying a low voltage.

As mentioned above, the liquid powders as the display media for example used in the present invention means an intermediate material having both of liquid properties and particle properties and exhibiting a self-fluidity without utilizing gas force and liquid force. Such liquid powders become particularly an aerosol state. In the information display panel according to the invention, the liquid powders are used in a state such that a solid material is relatively stably floating as a dispersant in a gas.

Then, an example of particles for the display media (hereinafter, sometimes refer to particles) constituting the display media in the information display panel according to the invention will be explained. The particles for the display media are used as the display media constructed by only the particles for the display media, or the display media constructed by mixing them with the other particles, or the display media constructed by controlling them into the liquid powders.

The particles include resin as a main ingredient and, according to need, charge control agent, coloring agent, inorganic additives, as is the same as the known one. Hereinafter, typical examples of resin, charge control agent, coloring agent and other additive will be explained.

Typical examples of the resin include urethane resin, urea resin, acrylic resin, polyester resin, acryl urethane resin, acryl urethane silicone resin, acryl urethane fluorocarbon polymers, acryl fluorocarbon polymers, silicone resin, acryl silicone resin, epoxy resin, polystyrene resin, styrene acrylic resin, polyolefin resin, butyral resin, vinylidene chloride resin, melamine resin, phenolic resin, fluorocarbon polymers, polycarbonate resin, polysulfon resin, polyether resin, and polyamide resin. Two kinds or more of these may be mixed and used. For the purpose of controlling the adherence to the substrate, acryl urethane resin, acryl silicone resin, acryl fluorocarbon polymers, acryl urethane silicone resin, acryl urethane fluorocarbon polymers, fluorocarbon polymers, silicone resin are particularly preferable.

Though charge control agents are not particularly specified to the following examples, examples of the negative charge control agent include salicylic acid metal complex, metal containing azo dye, oil-soluble dye of metal-containing (containing a metal ion or a metal atom), the fourth grade ammonium salt-based compound, calixarene compound, boron-containing compound (benzyl acid boron complex), and nitroimidazole derivative. Examples of the positive charge control agent include nigrosine dye, triphenylmethane compound, the fourth grade ammonium salt-based compound, polyamine resin, imidazole derivatives. Additionally, metal oxides such as ultra-fine particles of silica, ultra-fine particles of titanium oxide, ultra-fine particles of alumina, and so on; nitrogen-containing circular compound such as pyridine, and so on, and these derivates or salts; and resins containing various organic pigments, fluorine, chlorine, nitrogen and the like can be employed as the charge control agent.

As for a coloring agent, various kinds of organic or inorganic pigments or dye with various colors as described below are usable.

Examples of black pigments include carbon black, copper oxide, manganese dioxide, aniline black, activate carbon and the like.

Examples of blue pigments include C.I. pigment blue 15:3, C.I. pigment blue 15, Berlin blue, cobalt blue, alkali blue lake, Victoria blue lake, phthalocyanine blue, metal-free phthalocyanine blue, partially chlorinated phthalocyanine blue, first sky blue, Indanthrene blue BC and the like.

Examples of red pigments include red oxide, cadmium red, diachylon, mercury sulfide, cadmium, permanent red 4R, lithol red, pyrazolone red, watching red, calcium salt, lake red D, brilliant carmine 6B, rosin lake, rhodamine lake B, alizarin lake, brilliant carmine 3B, C.I. pigment red 2 and the like.

Examples of yellow pigments include chrome yellow, zinc chromate, cadmium yellow, yellow iron oxide, mineral first yellow, nickel titanium yellow, navel orange yellow, naphthol yellow S, hansa yellow G, hansa yellow 10G, benzidine yellow G, benzidine yellow GR, quinoline yellow lake, permanent yellow NCG, tartrazinelake, C.I. pigment yellow 12 and the like.

Examples of green pigments include chrome green, chromium oxide, pigment green B, C.I. pigment green 7, Malachite green lake, final yellow green G and the like.

Examples of orange pigments include red chrome yellow, molybdenum orange, permanent orange GTR, pyrazolone orange, Balkan orange, Indanthrene brilliant orange RK, benzidine orange G, Indanthrene brilliant orange GK, C.I. pigment orange 31 and the like.

Examples of purple pigments include manganese purple, first violet B, methyl violet lake and the like.

Examples of white pigments include zinc oxide, titanium oxide, antimony white, zinc sulphide and the like.

Examples of extenders include baryta powder, barium carbonate, clay, silica, white carbon, talc, alumina white and the like. Furthermore, there are Nigrosine, Methylene Blue, rose bengal, quinoline yellow, and ultramarine blue as various dyes such as basic dye, acidic dye, dispersion dye, direct dye, etc.

Examples of inorganic additives include titanium oxide, zinc oxide, zinc sulphide, antimony oxide, calcium carbonate, pearl white, talc, silica, calcium silicate, alumina white, cadmium yellow, cadmium red, cadmium orange, titanium yellow, Berlin blue, Armenian blue, cobalt blue, cobalt green, cobalt violet, ion oxide, carbon black, manganese ferrite black, cobalt ferrite black, copper powder, aluminum powder and the like.

Inorganic additives among these coloring agents may be used alone or in combination with two or more kinds thereof. Particularly, carbon black is preferable as the black coloring agent, and titanium oxide is preferable as the white coloring agent.

The above-mentioned color agents are composed to obtain a certain color of particles for display media.

Moreover, it is preferable to use particles for display media (hereinafter, sometimes refer to particles) of the present invention, whose average particle diameter d(0.5) ranges between 1 to 20 μm and which are even. If the average particle diameter d(0.5) exceeds this range, the image sharpness is sometimes deteriorated, and, if the average particle diameter is smaller than this range, an agglutination force between the particles becomes too large to prevent the movement of the particles.

Further, in the present invention as for the particle diameter distribution, the particle diameter distribution Span, which is defined by the following formula, is less than 5 preferably less than 3:

$$\text{Span}=(d(0.9)-d(0.1))/d(0.5)$$

(here, d(0.5) means a value of the particle diameter expressed by μm wherein an amount of the particles having the particle size larger than or smaller than this value is 50%, d(0.1) means a value of the particle diameter expressed by μm wherein an amount of the particles having the particle size smaller than this value is 10%, and d(0.9) means a value of the particle size expressed by μm wherein an amount of the particles having the particle size smaller than this value is 90%).

When the Span is set to no more than 5, each particle has similar particle diameter to perform an even particle movement.

Furthermore, as for a correlation between each particles, it is crucial to set a ratio of d(0.5) of the particles having smallest diameter with respect to d(0.5) of the particles having largest diameter to not more than 50 preferably not more than 10. Even if the particle diameter distribution Span is made smaller, the particles having different charge properties with each other are moved in the opposite direction. Therefore, it is preferred that the particle diameters are formed closely with each other and equivalent amounts of the particles are easily moved in the opposite direction. To this end, the above range is obtained.

Here, the particle diameter distribution and the particle diameter mentioned above can be measured by means of a laser diffraction/scattering method. When a laser light is incident upon the particles to be measured, a light intensity distribution pattern due to a diffraction/scattering light occurs spatially. This light intensity distribution pattern corresponds to the particle diameter, and thus it is possible to measure the particle diameter and the particle diameter distribution.

In the present invention, the particle diameter and the particle diameter distribution are obtained by a volume standard distribution. Specifically, the particle diameter and the particle diameter distribution can be measured by means of a measuring apparatus Mastersizer 2000 (Malvern Instruments Ltd.) wherein the particles setting in a nitrogen gas flow are calculated by an installed analysis software (which is based on a volume standard distribution due to Mie's theory).

A charge amount of the particle for display media properly depends upon the measuring condition. However, it has been found that the charge amount of the particle for display media in the information display panel substantially depends upon an initial charge amount, a contact with respect to the partition walls, a contact with respect to the substrates, a charge decay due to an elapsed time, and specifically a saturation value of the particles for the display media during a charge behavior is a main factor.

After various investigations by the inventors, it is found that an adequate range of the charged values of the particles for display media can be estimated by performing a blow-off method utilizing the same carrier particles so as to measure the charge amount of the particles for display media.

Further, when the display media driven in a gaseous space are applied to the dry type information display panel, it is important to control a gas surrounding the display media in a gap between the substrates, and a suitable gas control contributes an improvement of display stability. Specifically, it is important to set the relative humidity of the gas in the gap not more than 60% RH at 25° C., preferably not more than 50% RH.

The above gap means a gas portion surrounding the display media obtained by substituting occupied portions of the electrodes 5, 6 (in the case of arranging the electrodes inside the substrates), the display media 3, the partition walls 4 (in the case of arranging the partition wall), and a seal portion of the information display panel from the space between the opposed substrates 1 and 2 shown in FIGS. 1*a* and 1*b* to 5.

A kind of the gap gas is not limited as long as it has the humidity mentioned above, but it is preferred to use dry air, dry nitrogen gas, dry argon gas, dry helium gas, dry carbon dioxide gas, dry methane gas and so on. It is necessary to seal this gas in the information display panel so as to maintain the humidity mentioned above. For example, it is important to perform the operations of filling the display media and assembling the information display panel under an atmosphere having a predetermined humidity and to apply a seal member and a seal method for preventing a humidity inclusion from outside.

In the information display panel of the invention, a gap between the substrates may be adjusted so that the display media can be moved to maintain the contrast. The gap is adjusted normally to 10-500 μm, preferably 10-200 μm.

The volume occupied rate of the display media in an aerial space between the opposed substrates is preferably 5-70%, more preferably 5-60%. If the volume occupied rate of the display media exceeds 70%, the display media may become difficult to move, and if it is less than 5%, a sufficient contrast cannot be obtained and a sharp image display is not performed.

Example

Figure 25:
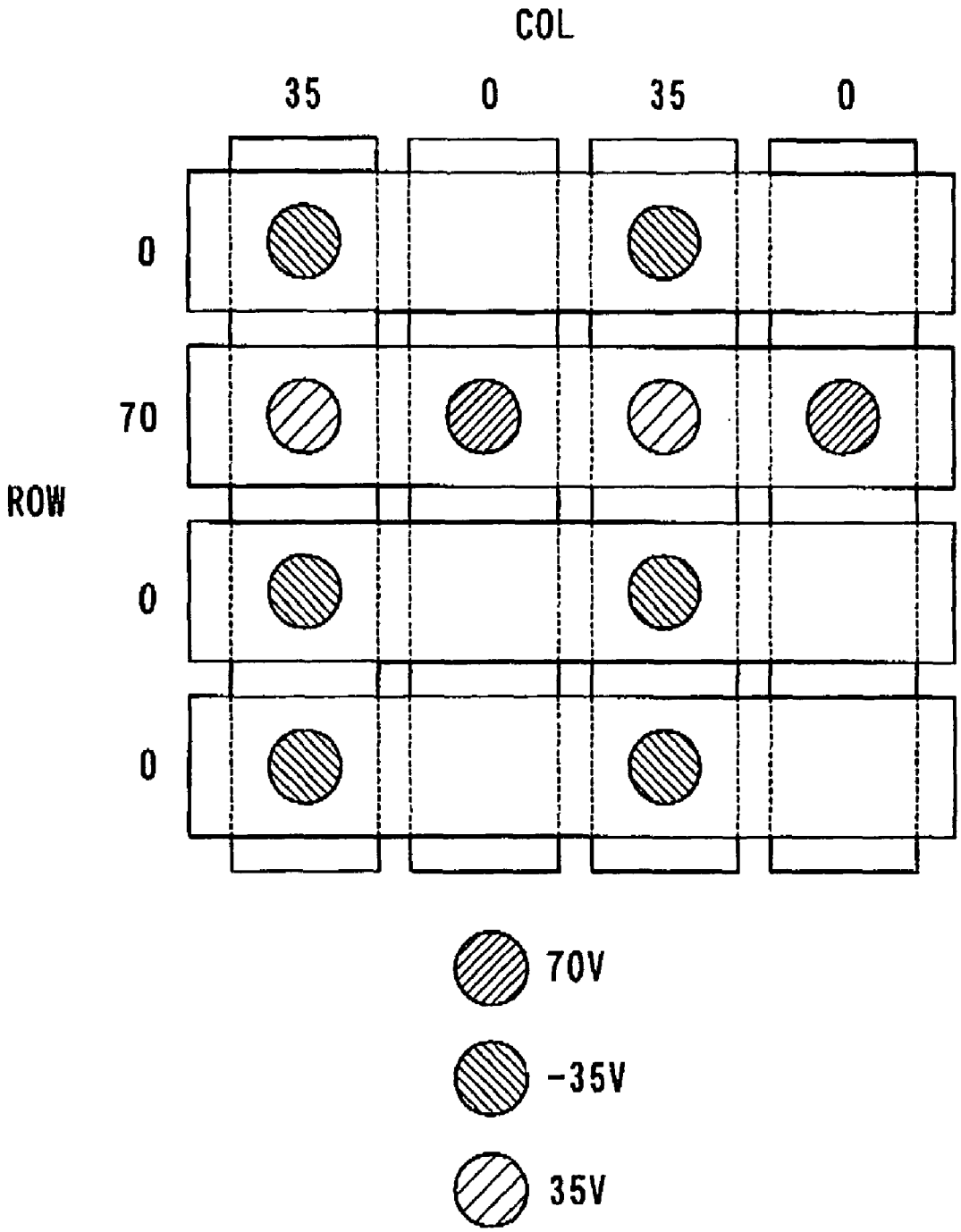
FIG. 25 is a schematic view showing one embodiment of a voltage applying pattern of the known driving method used in the example.
Figure 26:
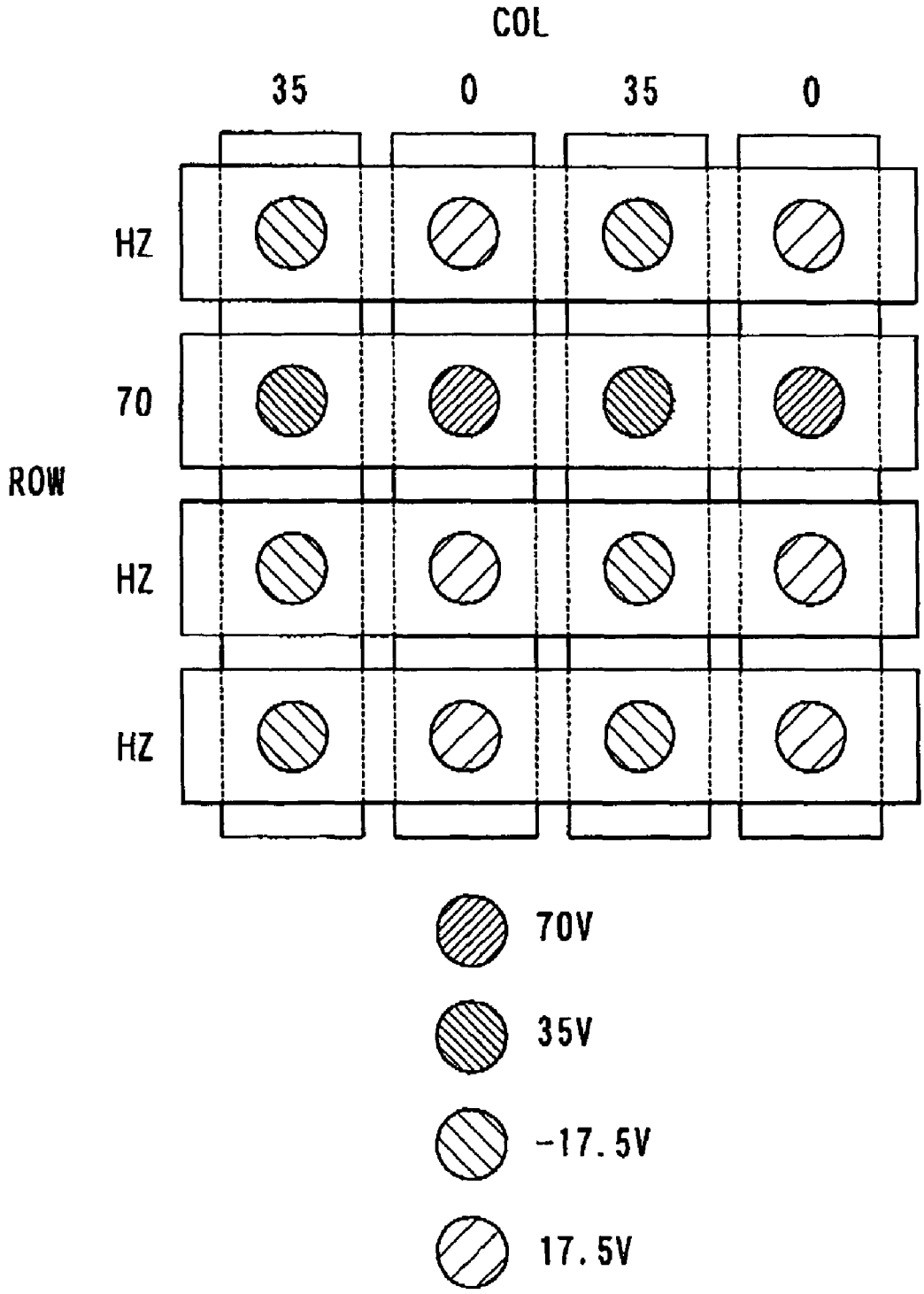
FIG. 26 is a schematic view illustrating one embodiment of a voltage applying pattern of the driving method according to the invention in which use is made of a line of open state (including a connection state under a high-impedance (HZ) state)
Figure 27:
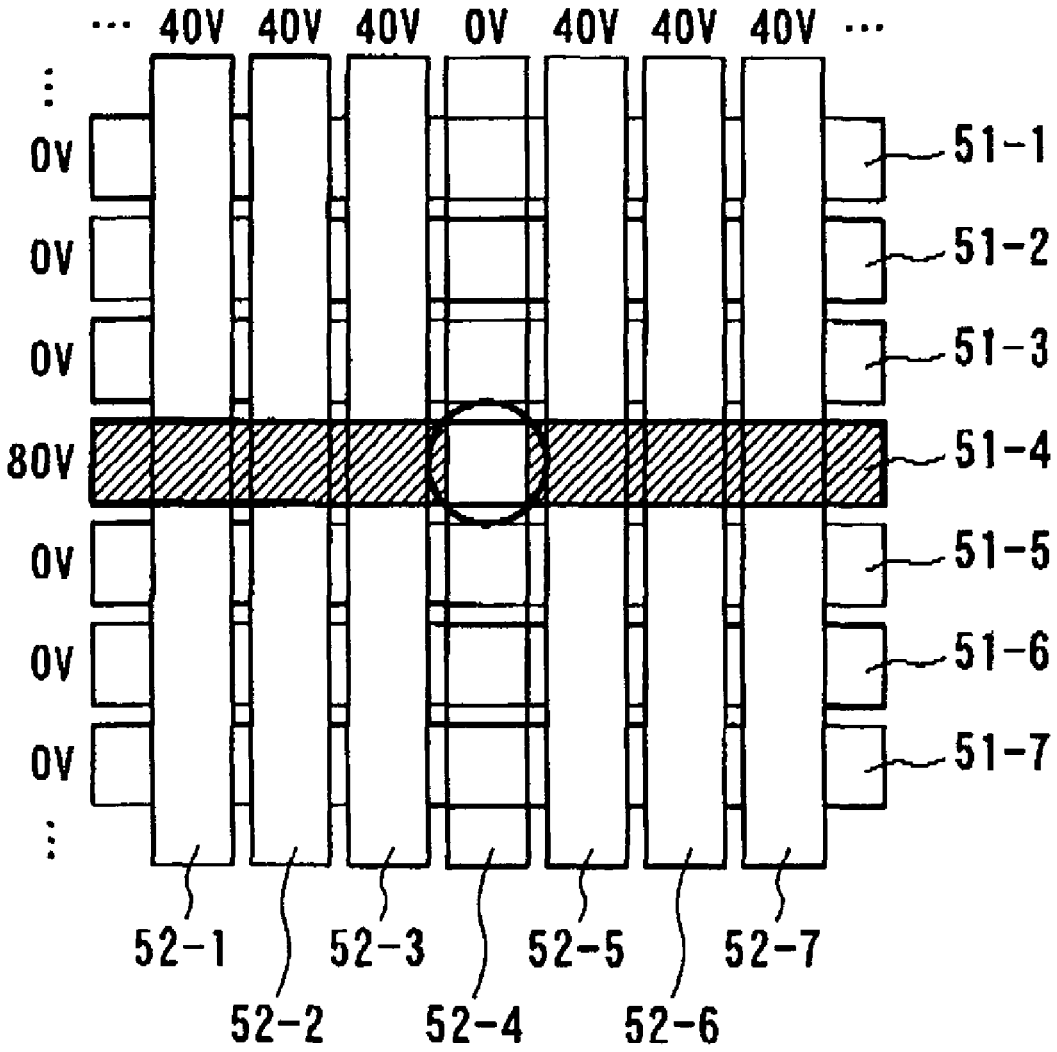
FIG. 27 is a schematic view explaining one embodiment of a known method of driving the information display panel.

Actually, by using the information display panel having the construction shown in FIG. 1*b*, the display media were moved according to a voltage applying pattern of the known driving method shown in FIG. 25 and a voltage applying pattern of the driving method of the invention using an open (including a connection state under a high impedance HZ state) line shown in FIG. 26 respectively so as to perform a display inversion of white/black checker-flag pattern image by 20,000 times repetition. After that, an optical density (OD value) of a white color display portion and a black color display portion was measured, and a contrast value was obtained by calculating a ratio between them. The results in the known driving method illustrated in FIG. 25 are shown in the following Table 1, and the results in the driving method according to the invention illustrated in FIG. 26 are shown in the following Table 2. Here, the measuring of contrast was performed by means of optical densitometor RD-10 series by GRETAG-MACBETH Inc. at room temperature in such a manner that OD value (B) of the black color portion and OD value (W) of the white color portion were measured by three times, an average of the black OD value (B) and the white OD value (W) was calculated, and it was obtained from a formula: contrast (CNT)=$10^{(B-W)}$. Here, OD value means an optical density.

TABLE 1

| | Black | White |
|---|---|---|
| First time | 1.625 | 0.791 |
| Second time | 1.633 | 0.787 |
| Third time | 1.634 | 0.791 |
| Average | 1.631 | 0.790 |
| Contrast | 6.934 | |

TABLE 2

| | Black | White |
|---|---|---|
| First time | 1.617 | 0.692 |
| Second time | 1.618 | 0.691 |
| Third time | 1.618 | 0.695 |
| Average | 1.618 | 0.693 |
| Contrast | 8.414 | |

From the results shown in Table 1 and Table 2, it is understood that, according to the driving method of the invention, a contrast is improved by about 20% from 6.934 (contrast of the known driving method) to 8.414 (contrast of the driving method according to the invention).

The information display panel, which is an object of to the invention, is preferably applicable to the display unit for mobile equipment such as notebook personal computers, PDAs, cellular phones, handy terminals and so on; to the electric paper such as electric books, electric newspapers, electric manual (instruction) and so on; to the bulletin boards such as signboards, posters, blackboards and so on; to the image display unit for electric calculator, home electric application products, auto supplies and so on; to the card display unit such as point cards, IC cards and so on; and to the display unit for electric advertisements, electric POPs, electric price tags, electric shelf tags, electric musical score, RF-ID device and so on.

In addition, the information display panel according to the invention is preferably used as an information display panel, wherein display is rewritten by means of external electric field forming means, i.e. a rewritable paper.

What is claimed is:

1. A method of driving an information display panel of a passive matrix driving type, in which display media are sealed in a space between two substrates, at least one substrate being transparent, and, in which an electrostatic field, which is generated from an electrode at scan side and an electrode at data side arranged respectively to the opposed substrates in an intersected manner, is applied to the display media so as to display information such as an image, comprising a construction such that at least two or more voltage values or an open state (including a connection state under a high-impedance state) are applied to at least one electrode, wherein an applying voltage of the selected electrode at scan side is VS1, at least one electrode among the non-selected electrodes at scan side is open (including a connection state under a high-impedance state), and an applying voltage of the selected electrode at data side is VD1, wherein whether a voltage applied to the non-selected electrode at data side is VD2 or an open state (including a connection state under a high-impedance state) is decided according to the number of the selected electrodes at data side, to which a voltage VD1 is applied, wherein at least one electrode among the non-selected electrode at data side is open (including a connection state under a high-impedance state); and an applying voltage of the other non-selected electrode at data side is VD2, and wherein VD1 is not equal to VD2.

2. The method of driving an information display panel according to claim 1, wherein an open state (including a connection state under a high-impedance state) is realized by a connection of transistors.

3. The method of driving an information display panel according to claim 1, wherein a dummy electrode is formed at a portion other than an information rewriting portion.

4. The method of driving an information display panel according to claim 3, wherein a capacitance of a sum of cells formed by the dummy electrodes arranged other than the information rewriting portion is one third or more of a capacitance of a sum of cells formed by the electrodes arranged to the information rewriting portion.

5. The method of driving an information display panel according to claim 3, wherein, in the case such that: an applying voltage of the selected electrode at scan side is VS1; at least one electrode among the non-selected electrodes at scan side is open (including a connection state under a high-impedance state); and an applying voltage of the selected electrode at data side is VD1; when the dummy electrode is formed with respect to the electrode at data side, a voltage is applied to the dummy electrode according to the number of the electrodes to which VD1 is applied, the number of the electrodes to which VD2 is applied, and the number of the electrodes which are an open state.

6. The method of driving an information display panel according to claim 1, wherein use is made of the information display panel, in which at least one group of the display media having optical reflectance and charge characteristics, formed by at least one group of particles, are sealed in the space between two substrates, at least one substrate being transparent.

7. The method of driving an information display panel according to claim 1, wherein the display media are particles or liquid powders, which are formed by at least one group of particles.

* * * * *